US009777484B2

(12) United States Patent
Header

(10) Patent No.: US 9,777,484 B2
(45) Date of Patent: Oct. 3, 2017

(54) HINGED GLASS HANDRAIL SILL

(71) Applicant: Gregory A. Header, Richland, PA (US)

(72) Inventor: Gregory A. Header, Richland, PA (US)

( * ) Notice: Subject to any disclaimer, the term of this patent is extended or adjusted under 35 U.S.C. 154(b) by 0 days.

(21) Appl. No.: 15/190,176

(22) Filed: Jun. 23, 2016

(65) Prior Publication Data

US 2016/0298337 A1 Oct. 13, 2016

Related U.S. Application Data

(63) Continuation-in-part of application No. 13/847,383, filed on Mar. 19, 2013.

(51) Int. Cl.
*E04B 1/00* (2006.01)
*E04B 5/00* (2006.01)
(Continued)

(52) U.S. Cl.
CPC ..... *E04F 11/1853* (2013.01); *E04F 11/1812* (2013.01); *E04F 2011/1823* (2013.01)

(58) Field of Classification Search
CPC ... E04H 17/16; E04B 2002/749; E04B 2/825; E04F 11/1812; E04F 11/1817; E04F 11/1851; E04F 11/1823; E04F 11/1853; E04F 2011/1823; E06B 3/5454; F16B 2/12; Y10T 403/76
(Continued)

(56) References Cited

U.S. PATENT DOCUMENTS 3,630,490 A 12/1971 Hogan, Jr.
RE28,643 E 12/1975 Blum
(Continued)

FOREIGN PATENT DOCUMENTS

EP 1277894 B1 11/2007
WO 2010111751 A1 10/2010

OTHER PUBLICATIONS

David Brian Mattei, Non-Final Office Action, Double-Hinged Glass Handrail Sill, U.S. Appl. No. 13/847,383, Applicant: Gregory A. Header, dated Mar. 12, 2014, United States Patent and Trademark Office , Alexandria, VA US.
(Continued)

*Primary Examiner* — Brian D Mattei
(74) *Attorney, Agent, or Firm* — Stone Creek Services LLC; Alan M Flum

(57) ABSTRACT

The invention is a double-hinged sill for adjustable securing the panels of a handrail system to a floor, the sill has U-shaped channel. A pair of hinged plates is pivotally mounted within the channel. A cylindrical hinge member is provided at the bottom end of each of the hinge plates and extends the length of the hinge plate. A groove for receiving the cylindrical hinge member is provided at the bottom of the sill. The pair of hinge plates is aligned within the sill as mirror images. A series of adjustment and locking screws are provided along the length of the sill and extend there through from either the top of the sill or the sides of the sill and a readapted to selectively impinge against the pair of hinge plates to movably adjust the plates inwardly against a glass panel or outwardly away from a glass panel to vertically align the same and lock it into place.

15 Claims, 18 Drawing Sheets

(51) Int. Cl.
*E04B 7/00* (2006.01)
*E04F 11/18* (2006.01)

(58) Field of Classification Search
USPC ..... 52/126.3–126.5, 241, 204.597, 204.64, 52/800.14, 204.65, 284; 256/24–26, 256/65.01, 67, 69
See application file for complete search history.

(56) References Cited

U.S. PATENT DOCUMENTS

| | | | | |
|---|---|---|---|---|
| 4,054,268 | A | 10/1977 | Sher | |
| 4,067,548 | A | 1/1978 | Murphy | |
| 4,103,874 | A | 8/1978 | Horgan, Jr. | |
| 4,920,717 | A | 5/1990 | Hopper, Jr. | |
| 6,419,209 | B1 | 7/2002 | Shepard | |
| 6,434,905 | B1 | 8/2002 | Sprague | |
| 6,517,056 | B2 | 2/2003 | Shepard | |
| 7,559,536 | B1 | 7/2009 | Hansen et al. | |
| 7,584,588 | B2 | 9/2009 | Kim | |
| 7,730,682 | B2 | 6/2010 | Nash | |
| 2002/0088188 | A1 | 7/2002 | Chang | |
| 2002/0195595 | A1 | 12/2002 | Shepherd | |
| 2010/0225040 | A1 | 9/2010 | Allen | |
| 2011/0260129 | A1 | 10/2011 | Schopf et al. | |
| 2012/0189378 | A1* | 7/2012 | Visa | E04F 11/1853 403/267 |
| 2012/0299233 | A1 | 11/2012 | Header | |
| 2014/0334874 | A1* | 11/2014 | Allen | E04C 1/42 403/374.3 |
| 2015/0110552 | A1* | 4/2015 | Yang | F16B 2/14 403/374.1 |
| 2017/0101784 | A1* | 4/2017 | Gonzato | E04F 11/1834 |

OTHER PUBLICATIONS

David Brian Mattei, Final Office Action, Double-Hinged Glass Handrail Sill, U.S. Appl. No. 13/847,383, Applicant: Gregory A. Header, dated Sep. 23, 2014, United States Patent and Trademark Office , Alexandria, VA US.

David Brian Mattei, Examiner's Answer in Response to Appeals Brief, Double-Hinged Glass Handrail Sill, U.S. Appl. No. 13/847,383, Applicant: Gregory A. Header, dated Jul. 1, 2015, United States Patent and Trademark Office , Alexandria, VA US.

* cited by examiner

FIG. 3
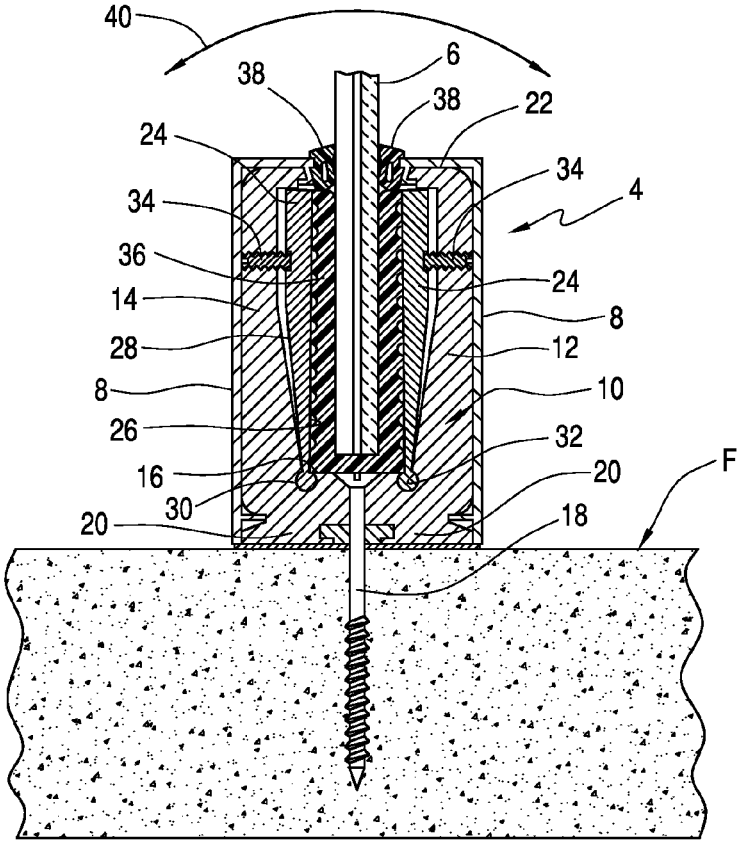
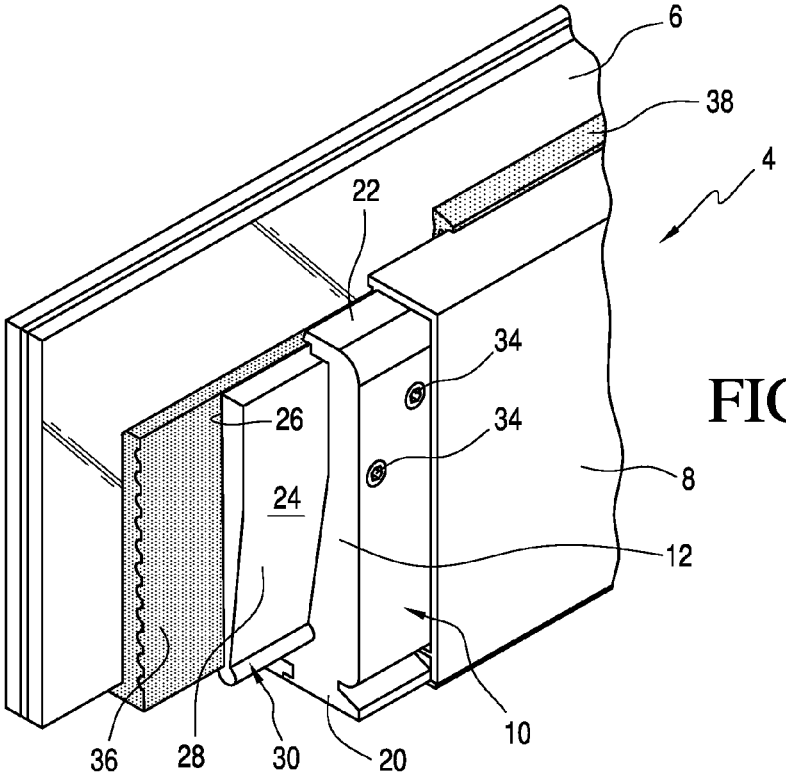
FIG. 4

FIG. 5
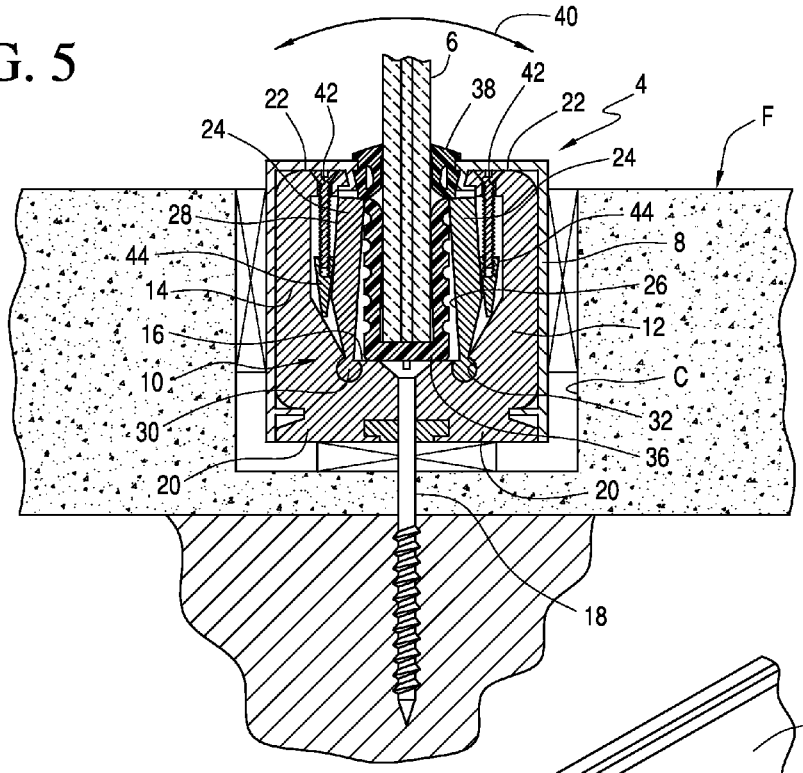
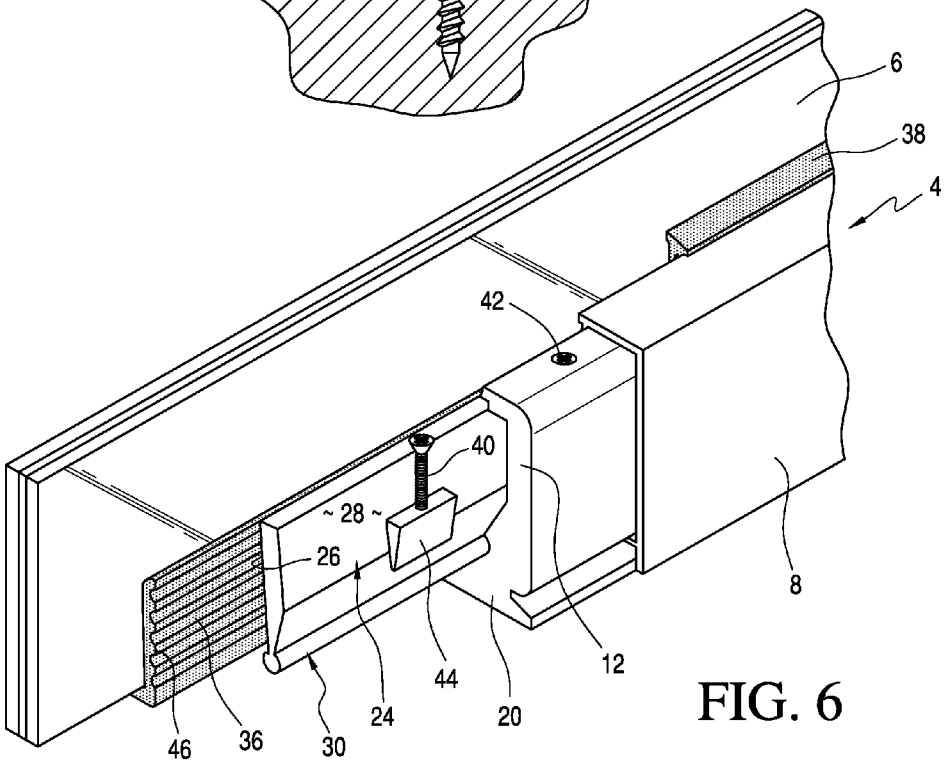
FIG. 6

HINGED GLASS HANDRAIL SILL

CROSS-REFERENCE

This application is a continuation-in-part of U.S. patent application Ser. No. 13/847,383 filed on Mar. 19, 2013. The entire contents of U.S. patent application Ser. No. 13/847,383 are hereby incorporated by reference.

FIELD OF THE INVENTION

This invention relates to handrails and more particularly, to a mounting system for securing a structural glass handrail to a floor.

BACKGROUND OF INVENTION

It is known to incorporate glass or other transparent panels within a guardrail or handrail to provide a functional and aesthetically pleasing railing. Generally speaking, such glass handrail systems comprise a series of vertically disposed glass panels that are aligned in an end-to-end relation. The bottom edges of the panels are fixed to the floor of the building while the top edges support a continuously extending top rail or handrail.

The above noted glass handrail systems are difficult to install. In particular, a base member or sill for holding the individual panes must be secured to the building floor. The individual glass panels are then fixed to the base member using an adhesive, grout or mechanical means. Spacers, blocks or shims are typically provided to properly align the panels relative to each other on a vertical plane. As is apparent, alignment of the individual panels is difficult and substantial labor is often required. The process is even more burdensome if the base member to which the panels are secured is recessed within the floor. Although some prior art systems provide an adjustment means on one side of the base member or sill, such devices do not provide uniform pressure and adjustment to the glass pane.

In view of the above, a need has existed for a means to easily and economically adjust and align the individual glass panels of a handrail system during installation. The present invention allows easy adjustment and alignment of glass handrails during installation and along the full length of the handrail. The invention incorporates a dual hinge within the sill of the handrail to allow adjustment and alignment of the glass panels forming the handrail after the sill is installed rather than requiring the sill itself be fully aligned on the floor before the glass panels of the handrail are installed. The invention enables a user to apply a uniform pressure to the glass panes and more readily align the glass panes, regardless of surface variations on the floor to which the sill is secured.

BRIEF SUMMARY OF THE INVENTION

The present invention is a sill for adjustable securing a glass panel of a handrail system to a floor, the sill having a U-shaped channel that may extend the length of the handrail system. A pair of hinge plates is pivotally mounted within the channel. A cylindrical hinge member is provided at the bottom end of each of the hinge plate and extends the length of the hinge plate. A groove for receiving the cylindrical hinge member is provided at the bottom of the sill. The pair of hinge plates is aligned within the sill as mirror images. A series of adjustment and locking screws are provided along the length of the sill at either the sill top or the sides and are adapted to selectively impinge against the pair of hinge plates to movably adjust the plates inwardly and against a glass panel or outwardly and away from a glass panel to cause vertical alignment of the same. The present invention is also directed to a glass handrail system incorporating the adjustable sill as set forth above.

The present invention is also directed to a sill for adjustably securing a glass panel to a floor comprising an elongated base member, the base member having a generally U-shaped interior channel adapted to receive a glass panel, a pair of sill plates, each of the pair of sill plates is pivotally mounted within the base member channel for receiving a glass panel therebetween, and adjustment and locking screws, the screws extending through the base member and transverse to the longitudinal axis thereof for adjustable contact against each of the pair of sill plates whereby selective rotation of the screws will impinge them against the pair of sill plates to pivot the same such that a glass panel disposed therebetween will be aligned and fixed into a locked position.

The present invention is also directed to a sill for adjustably securing a glass panel to a floor comprising an elongated base member having a generally U-shaped interior channel for receiving a glass panel, a pair of sill plates pivotally mounted within the channel for receiving a glass panel therebetween, and a series of adjustment and locking screws extending between the base member and the pair of sill plates for contact against the same whereby selective rotation of the screws will cause them to impinge against the pair of sill plates and pivot the same such that a glass pane disposed within the channel will be aligned and fixed into a locked position.

In embodiments that adjust the sill plate exclusively by using an adjustment screw, the inventor has observed that the force on the adjustment screw from the heavy weight of the glass panel can make the screw difficult to adjust and even strip. In addition, the screw would tend to back out over time. The inventor has observed that the use of wedge member can distribute the pressure more evenly and that wedge members can be provided to installers in a number of discrete thicknesses to provide fine variation of adjustment. The total number of wedges, increments, and total adjustment range can be determined based on desirable adjustment ranges and other factors including the convenience for the installer. The inventor has further discovered that the combination of the wedge member and adjustment screw provides for greater strength than an adjustment screw alone with the combination provide for a greater range of adjustment than the wedge member alone. In addition, the combination more evenly distributes the pressure against the glass because of the larger surface area of contact than just the adjustment screw alone.

In one embodiment, the wedge member is substantially t-shaped with an upper section forming the top of the t-shape and a lower section forming the stem of the t-shape. In one variation, the upper section can seat directly against the top surface of the sill member. This allows the wedge member to be placed anywhere along the top surface. This is especially advantageous with heavier glass, which can have tolerance problems with flatness or straightness. Here, the wedges can be placed any where along the top surface of the sill member as needed to compensate for irregularities in the glass.

In a second variation, the wedge member seats within an inset in the top surface of the sill member. This configuration is advantageous in installations where it is desirable to restrict the position of the wedge member to specific locations along the sill member rather than anywhere along the top surface.

The installer inserts wedge members of appropriate thickness between the sill plate and the inside of the side portions of the still on both sides of the glass panel. The wedges incrementally adjust the verticality of the glass panel. The wedges can be color coded or otherwise marked according to thickness so the installer can easily identify the correct wedges to use. After the installer installs the wedges, they do the final verticality adjustment using adjustment screws positioned on opposing sides of the glass panel. With the wedges inserted, there is significantly less force required to adjust the angle of the glass panel than the adjustment screws alone.

This "Brief Summary of the Invention" section has introduced a selection of concepts in simplified form that are described in more detail in the "Detailed Description of the Invention" section. This summary is not intended to identify essential features or limit the scope of the claimed subject matter.

BRIEF DESCRIPTION OF THE SEVERAL VIEWS OF THE DRAWINGS

FIG. 3 is an enlarged sectional view taken along lines 3-3 of FIG. 1;

FIG. 4 is perspective view of the assembly shown in FIG. 3 with portions broken away and without the floor being shown;

FIG. 5 is an enlarged cross-sectional view of an alternative embodiment of the present invention and where the sill is recessed within a floor;

FIG. 6 is a perspective view of the assembly shown in FIG. 5 with portions broken away and without the floor being shown;

DETAILED DESCRIPTION OF THE INVENTION

Figure 1:
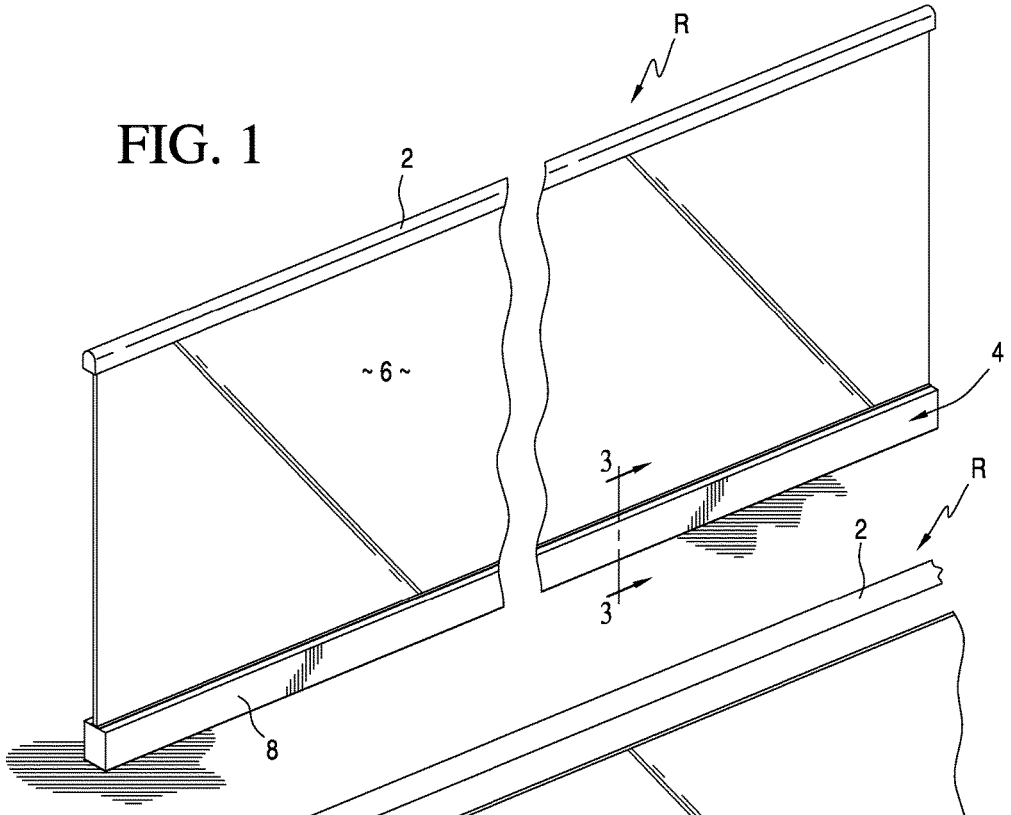
FIG. 1 is a perspective view showing a glass railing assembly in accordance with the present invention and with a section broken away.
Figure 2:
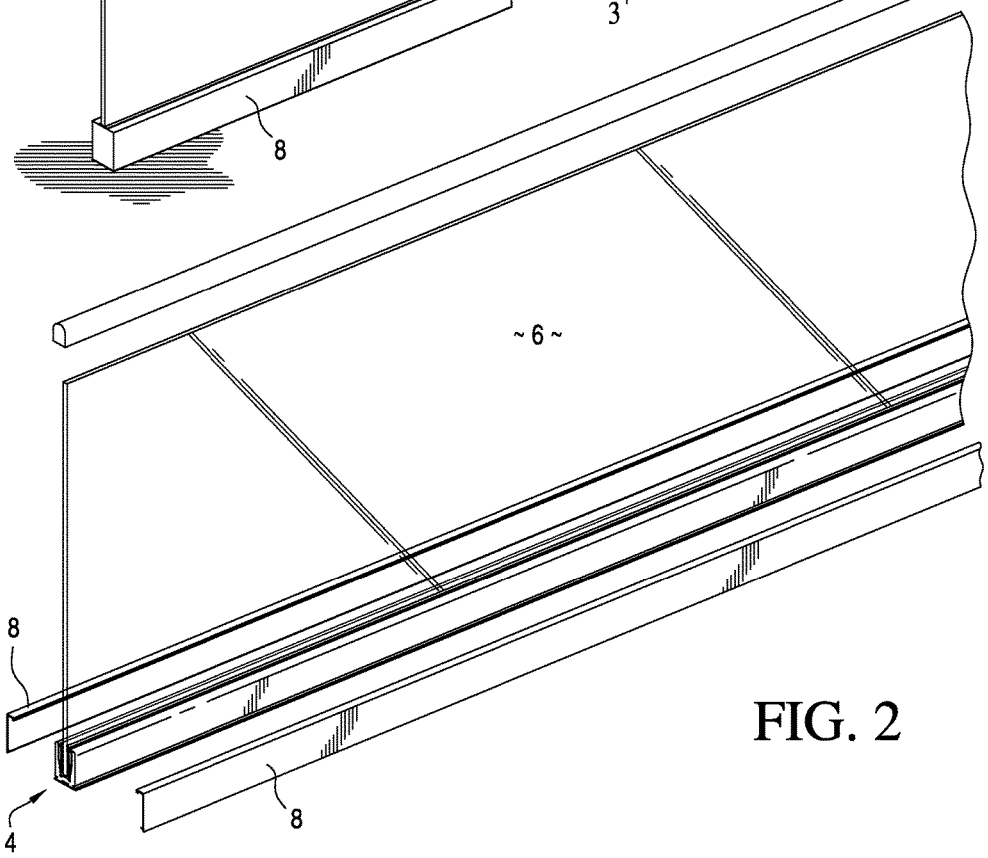
FIG. 2 is a partially exploded perspective view of the railing assembly show in FIG. 1.

Turning to FIGS. 1 and 2, a glass panel railing R according to the present invention is shown. The railing has a top handrail 2 and a base member 4 at an opposite bottom end. A series of individual glass panels 6 are set into the base member 4, the structure of which will be further discussed below.

Glass panel 6 is of variable length as best shown in FIG. 1. It may comprise a single panel or multiple panels that are aligned in an end-to-end relation. The panels 6 are tempered glass having varying thickness, although they are typically ½ inch (0.0127 meters) to ¾ inch (0.01905 meters) in thickness. As is apparent, it is within the scope of the present invention to provide panels in handrail R that are constructed from materials other than tempered glass, such as plastic or various other materials.

The present invention is shown in greater detail in FIGS. 3 and 4. An optional cover 8 may be provided on base member 4 and overlying sill member 10. The sill member 10 comprises a generally U-shaped channel formed by upstanding side portions 12 and 14 aligned as mirror images and having an opening for receiving a glass panel 6 and also having a bottom surface 16. As best shown in FIG. 3, a threaded fastener 18 e.g. screws, are provided to anchor the sill 10 to a floor F. A pair of foot members 20 extends from the bottom surface of sill 10. The optional cover 8 is press fit against the side portions of the side portions 12, 14 of the sill 10 at foot members 20 and along a top surface 22 of each sill side portion. The sill 10 is preferably constructed from metal, such as an extruded aluminum; however, other materials are within the scope of the invention provided they meet necessary engineering requirements of the handrail system.

A pair of adjustable sill plates 24 are disposed within the U-shaped channel of sill 10 and are aligned as mirror images of each other. In one embodiment, each of the sill plates 24 extends the full length of the sill and is pivotally or hingedly secured at the bottom surface 16 of sill 10. Each sill plate 24 has an interior surface 26 and an exterior surface 28, the interior surface 26 having a generally planar configuration and the exterior surface having a tapered surface from the top to the bottom of the sill plate 24 as shown in the drawing. As is apparent, the movable sill plates 24 may extend continuously on each side of the sill for the length of the sill. In the alternative, the movable sill plates 24 may be a series of individual plates on both sides of the sill, depending upon engineering requirement of the overall railing system.

The bottom end of each sill plate 24 is provided with a hinge that is shown in the drawings to comprise a cylindrical member 30, preferably extending the length of the sill plate 24, and a cooperating groove 32 formed within a corner region of the bottom surface 16 of sill 10. Groove 32 is sized to receive cylindrical member 30 such that each of the sill plates is adapted to freely pivot about the longitudinal axis of the sill 10. As is apparent, other hinge mechanisms are within the scope of the present invention. The cylinder and groove hinge shown in the various drawings is simple in construction, which reduces the chance of failure, and is economical to manufacture.

As best shown in FIG. 3, a series of adjustment and locking screws 34 extend through each sill side portion 12, 14 and generally transverse to the longitudinal axis of the side portions 12, 14. Selectively turning of the adjustment and locking screws 34 will cause each to move inwardly or outwardly through side portions 12, 14 and consequently, toward or away from the exterior surface of the sill plates 24. As best shown in FIG. 4, the adjustment and locking screws 34 are not aligned a long a common plane but instead disposed at varying locations of the side portions of the sill to provide selective adjustment against different regions of glass pane 6. It is within the scope of the present invention to provide adjustment screws that are aligned a long a common plane. As is apparent, the placement of the adjustment and locking screws in or out of alignment along the horizontal plane may be based upon the desired engineering performance of the sill.

A glass gasket 36 is provided around the bottom edge of the glass panel 6 and adjacent the interior surfaces 26 of each of the sill plates 24. A optional second gasket 38 may be provided for purposes of sealing the gap that extends between the top of the sill plates 24 and the glass pane 6. As is apparent, silicone or another sealant may be used in place of the optional second gasket 38.

During assembly of the glass handrail system R, sill plates 24 may be inserted within sill 10 either before or after the sill 10 is mounted to the floor F. The glass gasket 36 is then inserted between the pair of sill plates 24 and the bottom edge of the glass panel 6 is inserted within the glass gasket 36. The adjustment and locking screws 34 are selectively turned along the length of the sill 10 to cause them to impinge against the exterior sides 28 of the sill plates 24 and thereby align each of the glass panels 6 along an arc as indicated by arrow 40. The present invention provides adjustment along both sides of sill to enable a full and complete alignment of the glass panels 6. The adjustment and locking screws on both sides of the sill enables rapid alignment of the glass panes and ensures a consistent torque is applied to the glass panes. Once proper alignment has been achieved, the adjustment and locking screws are further tightened in an equal measure to uniformly lock the glass panel 6 into place within the sill 10.

Turning to FIGS. 5 and 6, a second embodiment of the present invention is shown. This embodiment provides a base member and sill adapted to be recessed within the floor F of a building and providing a glass pane alignment mechanism on both side of the sill 10. Floor F is shown to have a recessed channel C for receiving the base member 4. An optional cover 8 may be provided on the sides of recessed base member 4 and overlying sill member 10. The sill member 10 is shown to comprise a generally U-shaped channel formed by upstanding side portions 12 and 14 aligned as mirror images and forming an opening for receiving a glass panel 6 and including a bottom surface 16. As best shown in FIG. 5, threaded fasteners 18 e.g. screws, are provided to anchor the sill 10 within the channel C of floor F. A pair of foot members 20 extends from the bottom surface of the sill 10. The optional cover 8 is press fit against the side portions 12, 14 of the sill 10 and at foot members 20 and along a top surface 22 of each of the side portion 12, 14. The sill 10 is preferably constructed from metal, such as extruded aluminum; however, other materials are within the scope of the invention provided they meet engineering requirements.

A pair of movable sill plates 24 are disposed within the U-shaped channel of sill 10 and are aligned as mirror images of each other. The sill plates 24 may extend the length of the sill 10 and are pivotally or hingedly secured at the bottom surface 16 of sill 10. Each sill plate 24 has an interior surface 26 and an exterior surface 28, the interior surface 26 having a generally planar configuration and the exterior surface 28 having a tapered surface toward bottom of the sill plate 24. As is apparent, the movable sill plates may extend continuously on each side of the sill for the length of the sill. In the alternative, the movable sill plates may be provided as a series of separate plates on each side depending upon engineering requirement of the overall railing.

The bottom of each sill plate 24 is provided with a hinge mechanism that is shown in the drawings to comprise a cylindrical member 30, preferably extending the length of the sill plate 24, and a cooperating groove 32 formed within a corner region of the bottom surface of sill 10. Groove 32 is sized to receive cylindrical member 30 such that each of the sill plates is adapted to freely pivot about the longitudinal axis of the sill 10. Other hinge mechanisms are within the scope of the present invention.

As best shown in FIG. 5, a series of adjustment and locking wedge screws 42 extend through a aperture within each of the top surfaces of the sill side portions 12, 14 and are aligned transverse to the longitudinal axis of the side portions. The adjustment and locking wedge screws 42 are threadedly connection at one end to a wedge member 44. The adjustment and locking wedge screws 42 extend between the side portions 12, 14 of the sill 10 and the exterior surface 28 of the sill plates 24. Selectively turning of the adjustment and locking wedge screws 34 causes the associated wedge member 44 to be moved downwardly or upwardly between the sides of the sill and the sill plates.

A glass gasket 36 is provided around the bottom edge of the glass panel 6 and adjacent the interior surfaces 26 of each of the sill plates 24. As can be seen, the exterior surface of the gasket 36 is shown to have ridges 46. A second, optional second gasket 38 may be provided for purposes of sealing the gap extending between top of the sill plates 24 and the glass pane 6. As note earlier, silicone or another sealant may be used in place of the optional second gasket 38.

During handrail assembly, sill plates 24 may be inserted within the sill 10 either before or after the sill 10 is mounted within the recess C of the floor F. The glass gasket 36 is then inserted between the pair of sill plates 24 and the bottom edge of the glass panel 6 is inserted within the glass gasket 36. The adjustment and locking wedge screws 42 are selectively rotated along the length of the sill 10 to cause the associated wedge members 44 to impinge against the exterior sides 28 of each of the sill plates 24 and enable alignment of each of the glass panels 6 along the arc of travel indicated by arrow 40. As is apparent, the present invention permits adjustment on both sides of the sill which provides a full and complete alignment of the glass panels 6. Once proper alignment has been achieved, the adjustment and locking wedge screws are further tightened in an equal measure to uniformly lock the glass panel 6 into place within the sill 10.

Figure 7A:
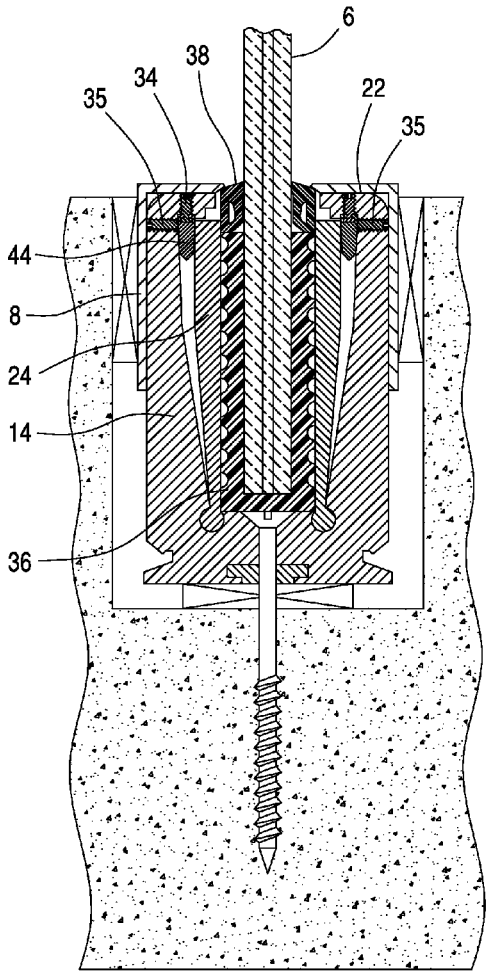
FIGS. 7A and 7B are enlarged cross-sectional views of another embodiment of the present invention.
Figure 7B:
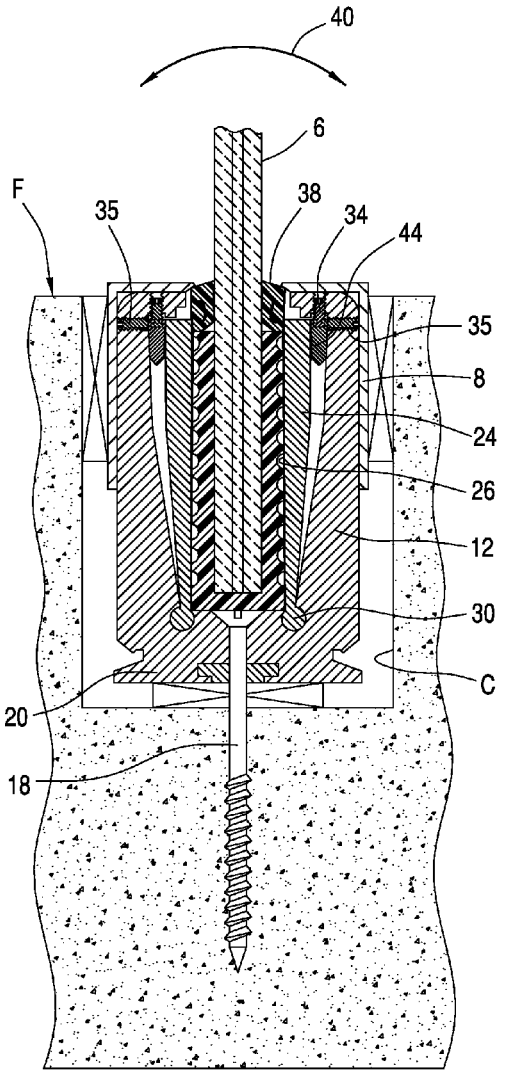

FIGS. 7A and 7B illustrate an alternative embodiment of the recessed sill shown in FIGS. 5 and 6. As best seen in FIG. 7A, adjustment screw 34 does not include an enlarged head. Turning to 7B, rotation of the adjustment screws 34 in a clockwise direction cause it to recess within the aperture provided in a top surface 22 of the sill sides 12, 14. The cooperating wedge member 44 provided on one end of the adjustment screw 34 is thereby caused to be moved downwardly between the exterior surfaces 28 of the sill plates 24 and the interior sides of the sill and force sill plate 24 inwardly against the glass gasket 36 and glass panel 6. Selective adjustment by the screws 34 along each side of the sill enable the glass panel 6 to be property aligned along an are illustrated by arrow 40. Following alignment, set screws 35 are tightened to lock the adjustment screw and glass panels into place.

Figure 8A:
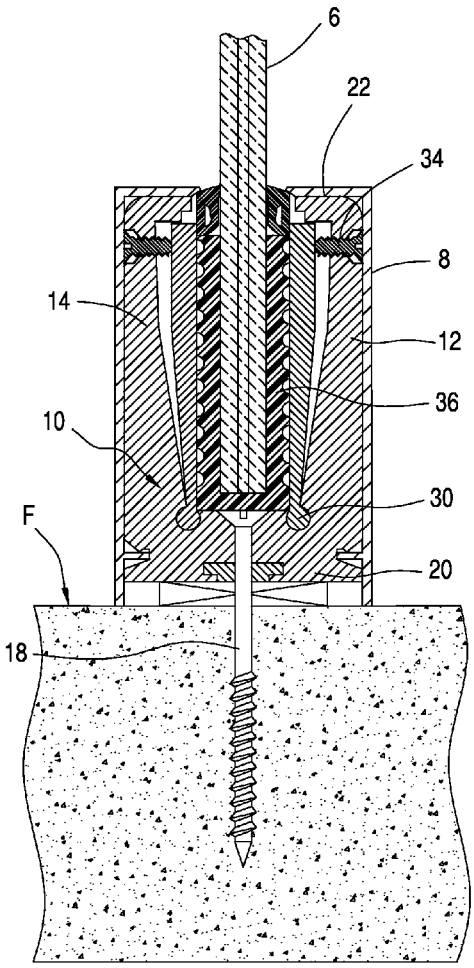
FIGS. 8A and 8B are enlarged cross-sectional views of another embodiment of the present invention.
Figure 8B:
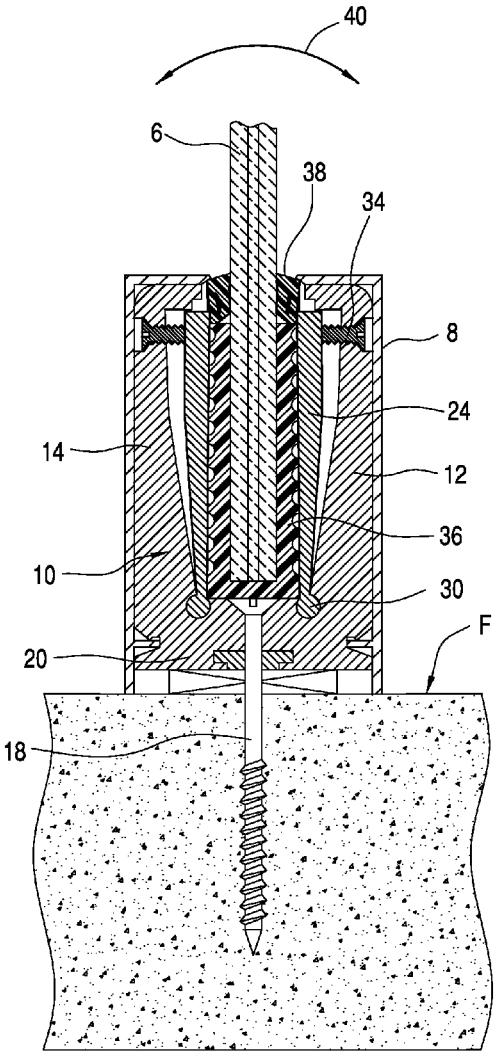

FIGS. 8A and 8B illustrate an alternative embodiment of the recessed sill shown in FIG. 3. As best seen in FIG. 8A, the adjustment and locking screws 42 include a head provided on the screw member. Turning to FIG. 8B, rotation of the adjustment and locking screws 34 in a clockwise direction cause it to recess within an aperture extending within the sides 12, 14 of sill 10 and also against sill plate 24 such that the sill plates are caused to move inwardly against the glass gasket 36 and glass panel 6. Selective adjustment along each side of the sill by the various adjustment and locking screws 42 allow the glass panel 6 to be property aligned along the arc of arrow 40. Following alignment, additional tightening of each screw in a uniform manner along the length of the sill will firmly lock each of the glass panes 6 into place.

Figure 9:
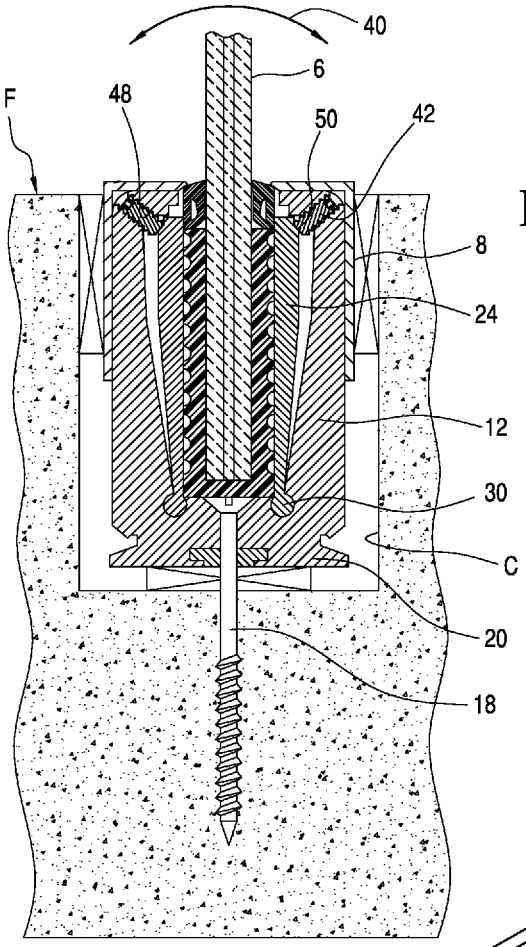
FIG. 9 is an enlarged cross-sectional view of an another embodiment of the present invention where the sill recessed into a floor.
Figure 10:
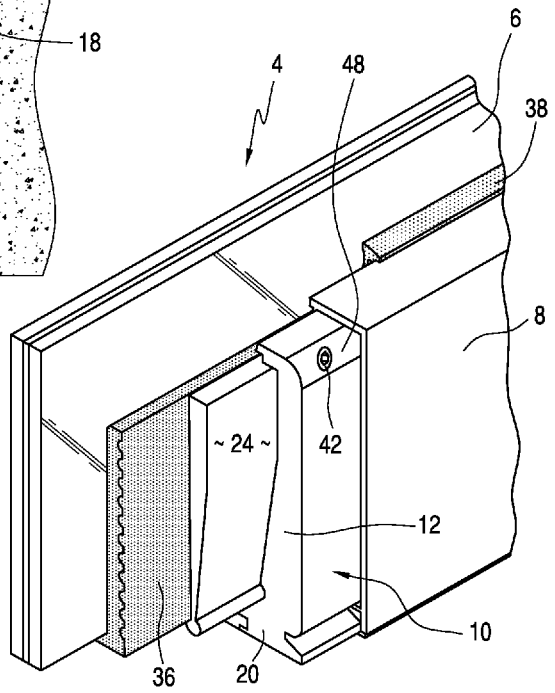
FIG. 10 is a perspective view of the assembly shown in FIG. 9 with portions broken away and without the floor being shown.

FIGS. 9 and 10 illustrate another embodiment of the present invention as directed to an adjustable sill 10 adapted to be recessed within a floor F. In this embodiment, the adjustment and locking screws 42 extend through an upper corner aperture 48 of the sill side portions 12, 14 to selectively impinge against the sill plates 24 at an incline. As best shown in FIG. 9, a continuous or discrete abutment surface 50 is provided along an upper edge of the sill plate 24 against which the adjustment and locking screw 34 impinges to urge the sill plates 24 inwardly or outwardly against a glass pane 6 to adjust and lock the same along arc 40.

Figure 11:
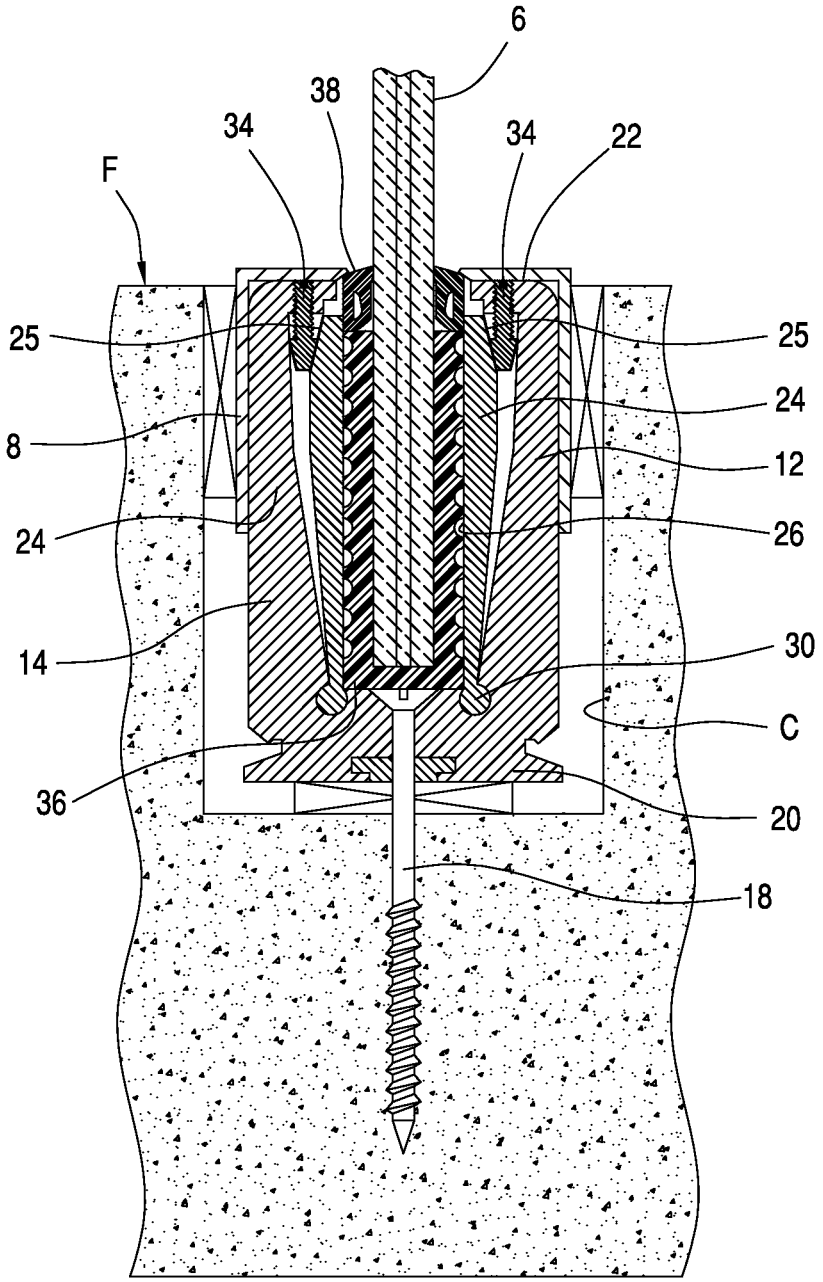
FIG. 11 is an enlarged cross-sectional view of another embodiment of the present invention where the sill is recessed into the floor.
Figure 12:
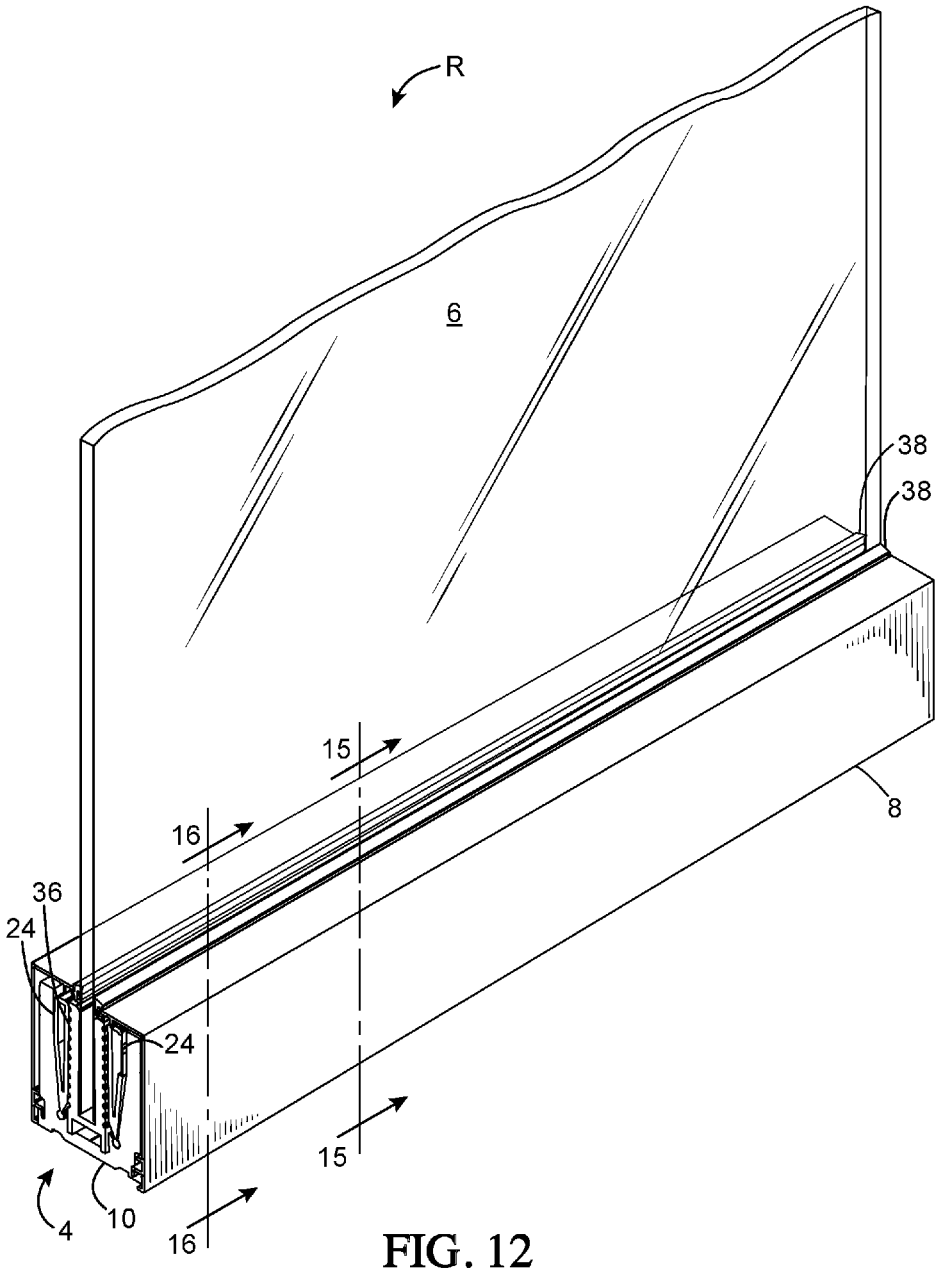
FIG. 12 shows, in top front perspective view, an alternative embodiment of a lower portion of a glass railing assembly that utilizes a wedge member.

FIG. 11 illustrates another embodiment of the present invention as specifically directed to an adjustable sill where the double sill plates 24 are angled. A series of adjustment and locking screws 34 having a tapered end portion extend through a threaded aperture within each of the top surfaces of the sill side portions 12, 14. The adjustment and locking screws 34 extend between the side portions 12, 14 of the sill 10 and the exterior surface 28 of the sill plates 24. The upper region of the sill plates 24 are provided with an angled edge surface 25 against which the tapered end portion of the locking screw may contact. Selective rotation of the adjustment and locking screws 34 causes the associated wedge member 44 to slidingly engage against the angled edge 25 of the sill plates which in turn causes the sill plate to adjustably move the glass panel 6 and cause alignment of the same. Following adjustment, each of the locking screws 34 are further tightened to fix the glass panels 6 into place.

Figure 15:
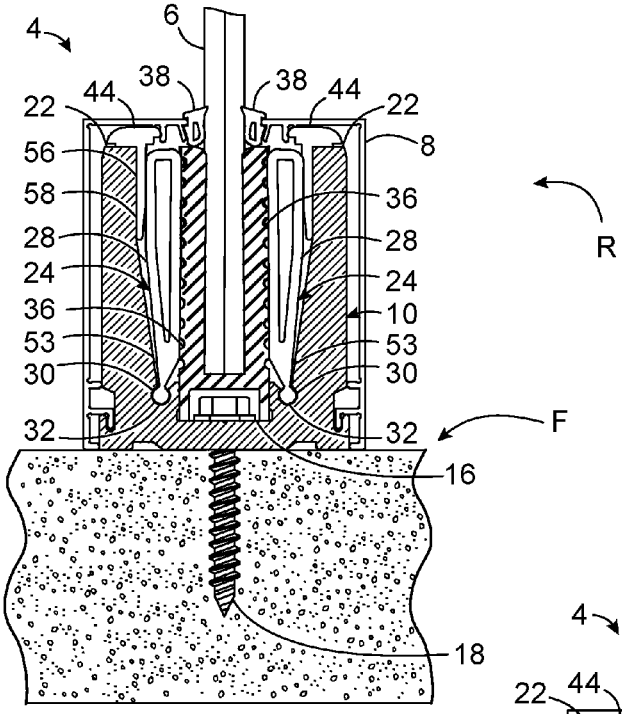
FIG. 15 shows a sectional view of the glass railing assembly of FIG. 12 taken along section lines 15-15.
Figure 16:
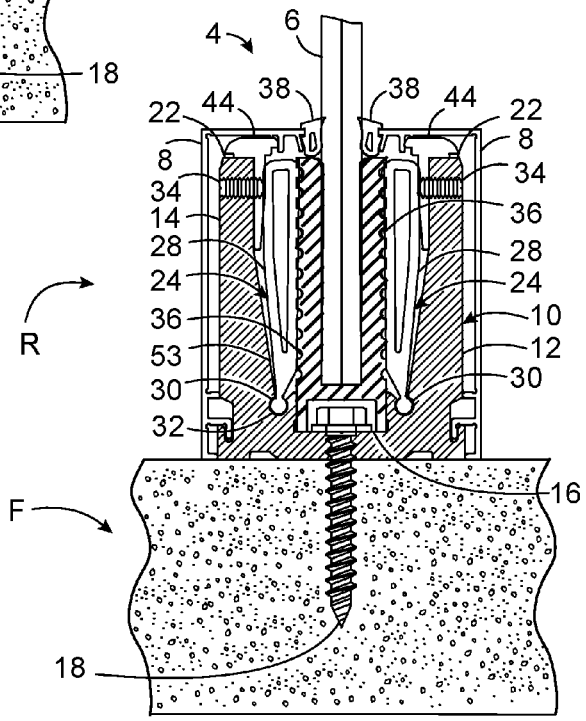
FIG. 16 shows a sectional view of the glass railing assembly of FIG. 12 taken along section lines 16-16.
Figure 17:
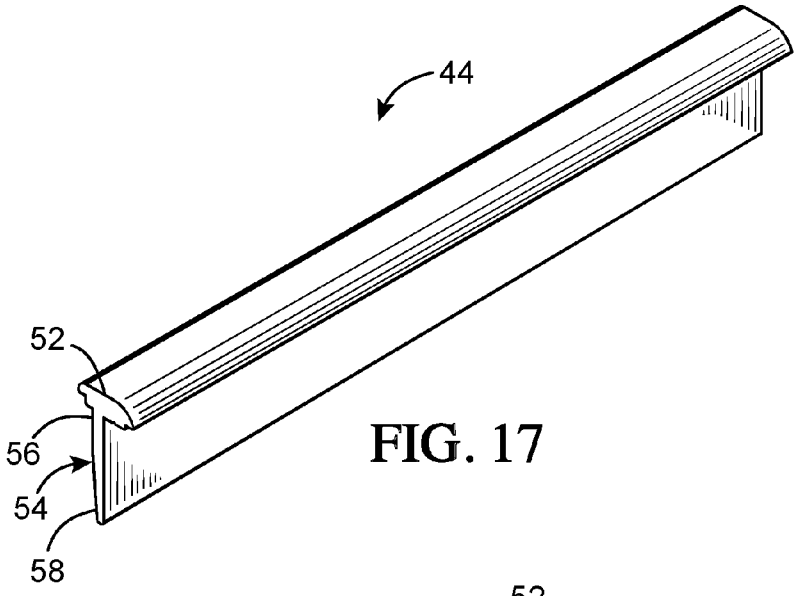
FIG. 17 shows, in top perspective view, a wedge member typical of what could be used in the embodiments of FIGS. 12-16 and FIGS. 20-23.
Figure 18:
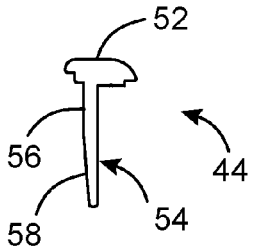
FIG. 18 shows, in side view, the wedge member of FIG. 17.
Figure 19:
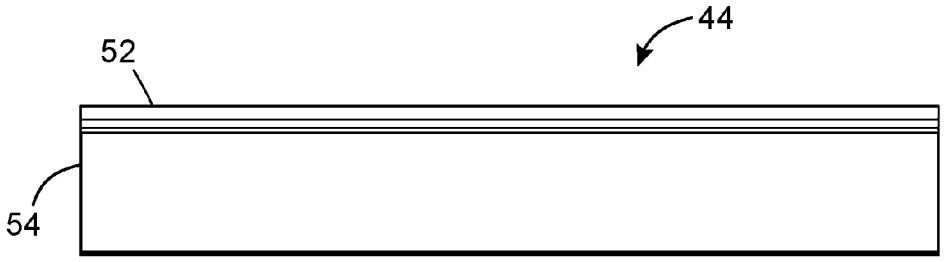
FIG. 19 shows, in front view, the wedge member of FIG. 17.
Figure 20:
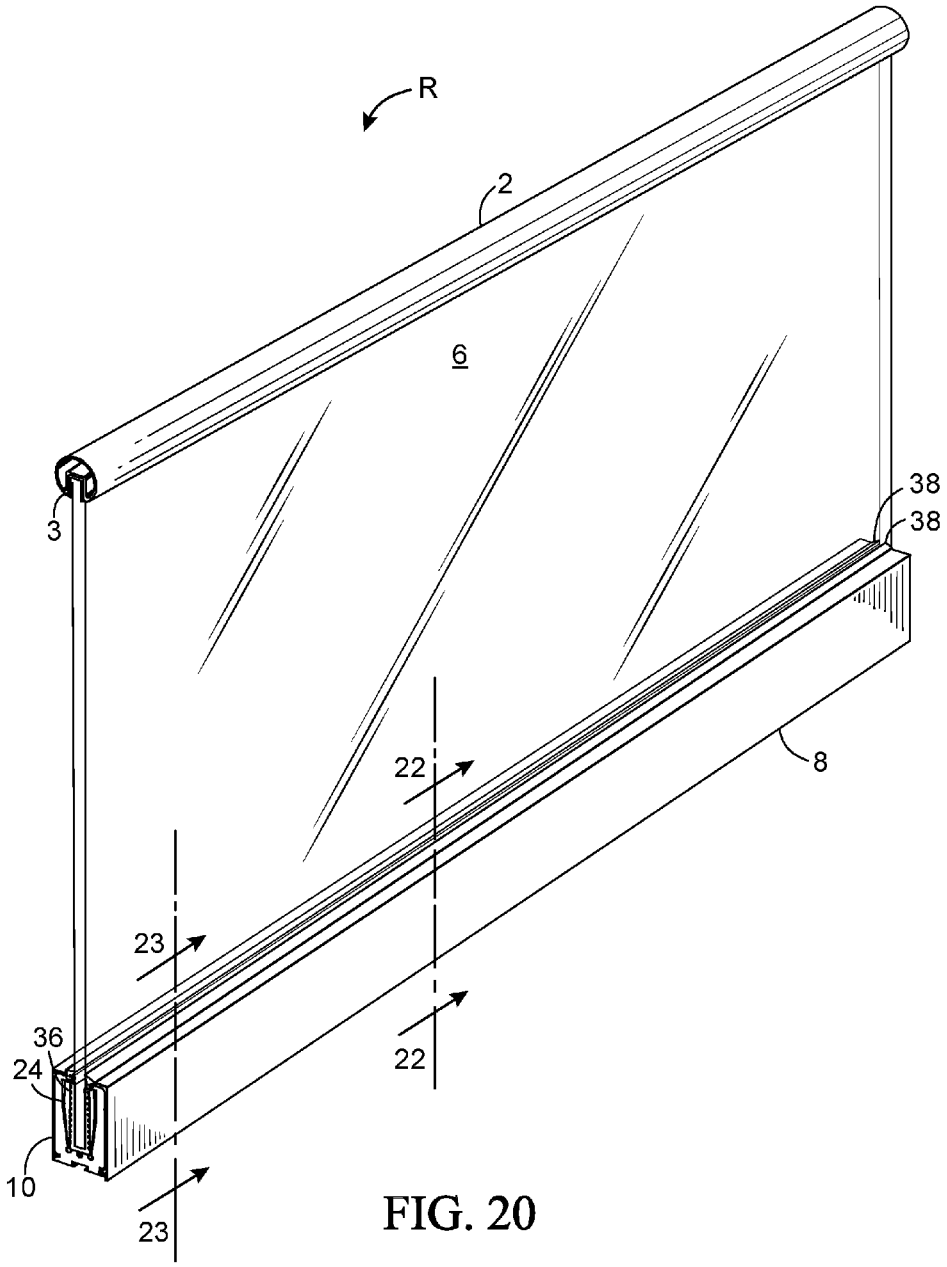
FIG. 20 shows, in top front perspective view, an another alternative embodiment a glass railing assembly utilizing a wedge member.
Figure 21:
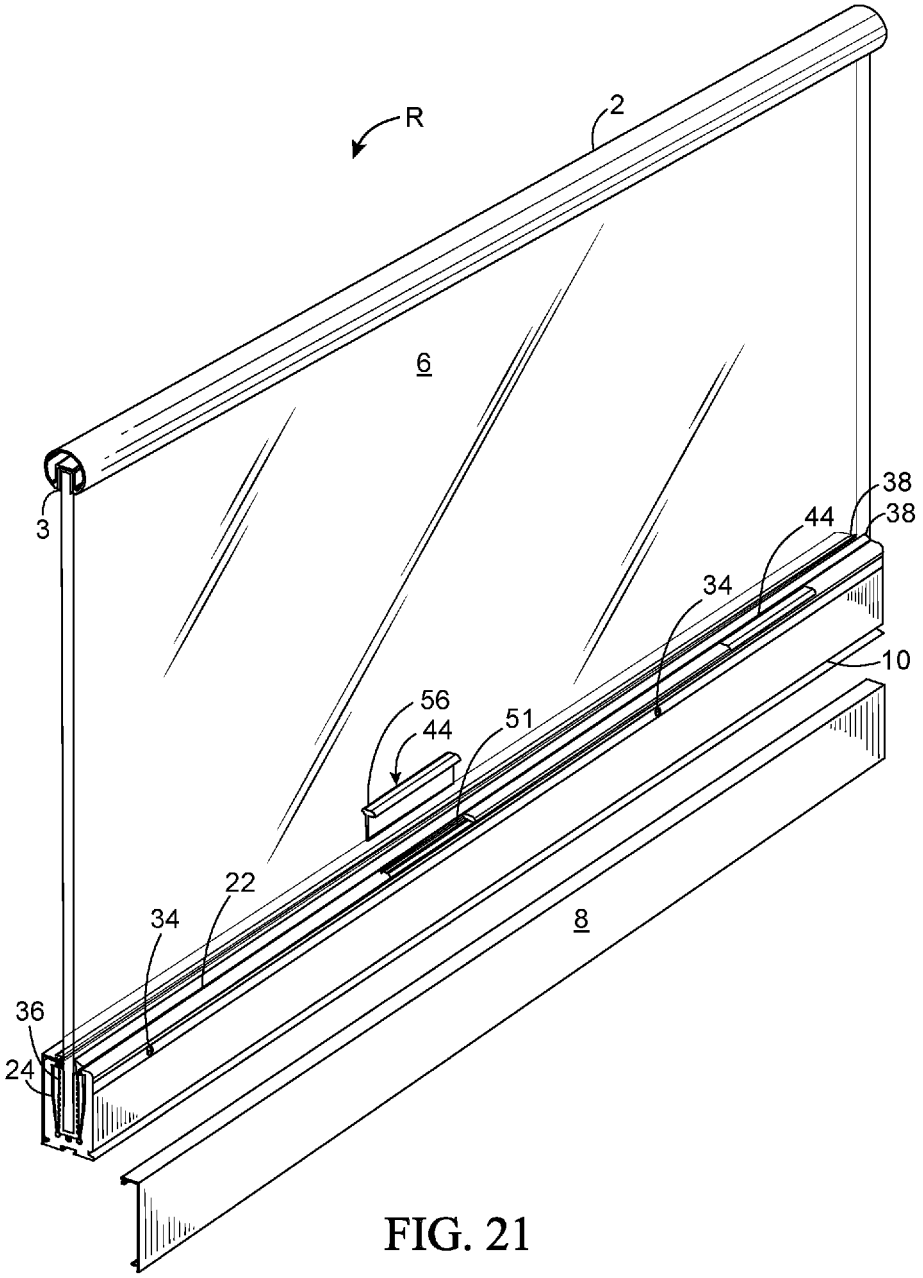
FIG. 21 shows, in top front perspective view, the glass railing assembly of FIG. 20 with the optional cover exploded away.

FIGS. 12-23 show two variations of an embodiment the uses a wedge member 44, shown in FIGS. 13-19 and 21-23, in combination with an adjustment screws 34 placed on opposing sides of the sill 10, shown in FIGS. 13, 16, 21, and 23, to adjust the angle of the glass panel 6. FIGS. 17-19 show one embodiment of the wedge member 44 that can be used in both variations. The primary difference the first variation of FIGS. 12-16 and the second variation of FIGS. 20-23, as best shown in FIGS. 13-16 and 21-23, is the way in which the wedge member 44 seats against the sill member 10. As illustrated in FIGS. 13-16, in the first variation, the wedge member 44 seats directly against the top surface 22 of the sill member 10. The first variation allows the wedge member 44 to be placed anywhere along the top surface 22. As illustrated in FIG. 21, in the second variation, wedge member 44 seats within an inset 51 in the top surface 22. With the wedge member 44 fully seated in the inset 51, the top of the wedge member 44 is shown being flush with the top surface 22. This is advantageous in installations where it is desirable to restrict the position of the wedge member 44 to specific locations along the sill member 10.

Figure 13:
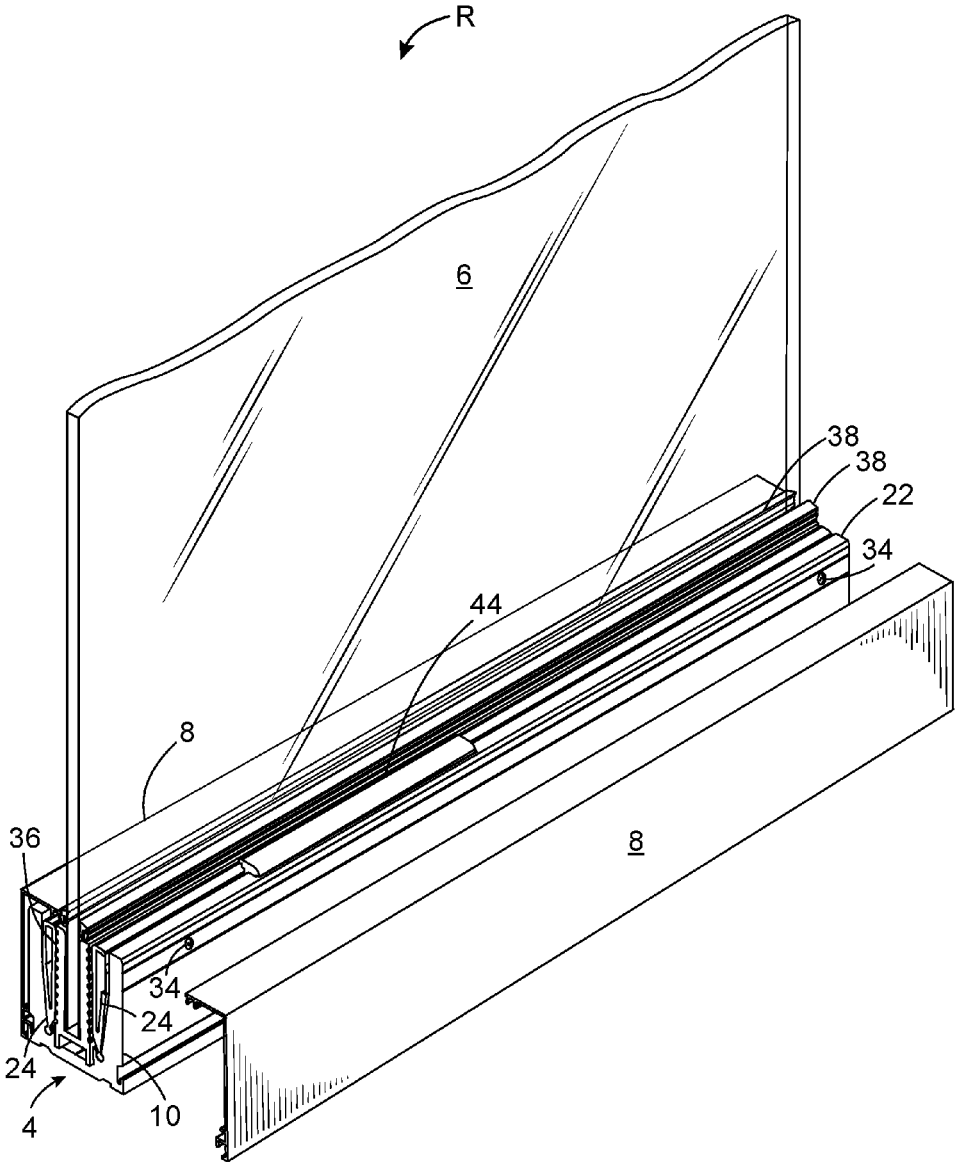
FIG. 13 shows, in top front perspective view, the lower portion of the glass railing assembly of FIG. 12 with the optional cover exploded away.
Figure 14:
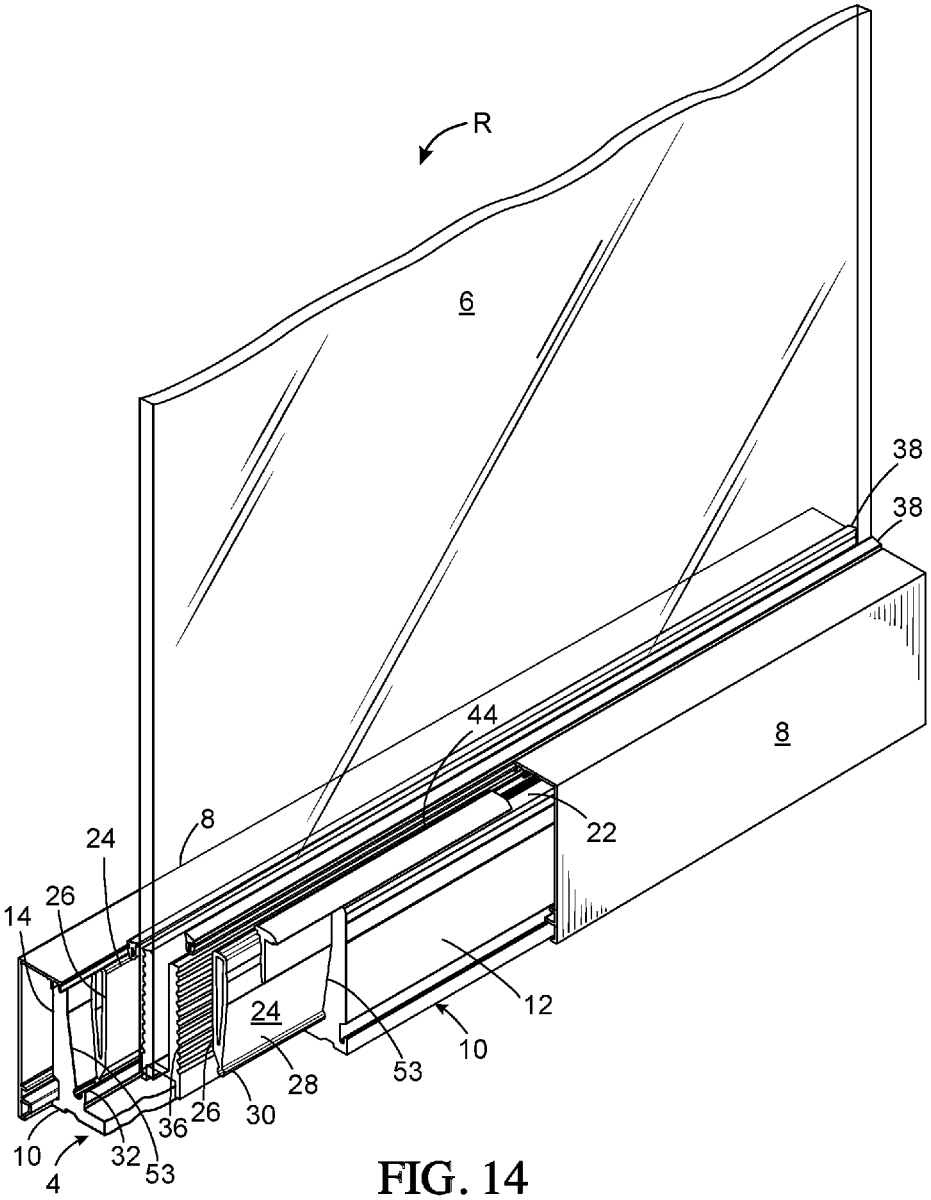
FIG. 14 shows in top front perspective view, the lower portion of the glass railing assembly of FIG. 12 with portions progressively cutaway to reveal the structure of the glass railing assembly.

Referring to the first variation of FIGS. 12-16, FIG. 12 shows, the lower portion of the glass railing assembly R in top front perspective view showing glass panel 6 projecting upward from the base member 4 with the base member 4 covered by the optional cover 8. FIG. 13 shows, in top front perspective view, the lower portion of the glass railing assembly R of FIG. 12 with the optional cover 8 exploded away from the base member 4. FIG. 14 shows in top front perspective view, the lower portion of the glass railing assembly R of FIG. 12 with the optional cover 8, the base member 4, sill plate 24, glass gasket 36, u-shaped interior channel 53, and the sill member 10, progressively cutaway to reveal the structure of the glass railing assembly R. FIG. 15 shows a sectional view of the glass railing assembly R of FIG. 12 taken along section lines 15-15. FIG. 16 shows a sectional view of the glass railing assembly R of FIG. 12 taken along section lines 16-16. FIGS. 15-16 show the sill 10 secured to the floor F by a threaded fastener 18 able to withstand the day-to-day forces and rotational torque experienced by the glass handrail assembly R. The threaded fastener is seated on the bottom surface 16 of the u-shaped interior channel 53 of the sill 10. Here the floor F is illustrated as concrete and the threaded fastener 18 is a concrete anchor bolt. However, the floor F can be of any suitable construction able to withstand the rotational forces applied against the handrail. The threaded fastener 18 can any threaded fastener 18 readily known to one skilled in the art for appropriately securing the sill 10 to floor F. For example, the floor F could be wood joist or steel beam construction, and the threaded fastener 18, a fastener suitable for anchoring to those materials.

Referring to FIGS. 12-16, the bottom longitudinally edge of the glass panel 6 is secured within a sill 10. The bottom longitudinal edge of the glass panel 6 is seated against a glass gasket 36 that is illustrated having substantially u-shape. The glass gasket 36 is illustrated as a "marine glaze gasket" where the gasket extends along and surrounds the bottom longitudinal edge and a portion of the opposing sides of the glass located immediately adjacent from the bottom longitudinal edge. A pair of optional second gaskets 38 is positioned on corresponding sides of the glass panel 6 between the glass panel 6 and the top longitudinal inside edge of the sill 10 and provides a watertight seal between the glass panel 6 and the sill 10. Alternatively, a glazing sealant, such as a silicone sealant or alternatively, a structural glazing sealant, can be substituted for the optional second gaskets 38.

A pair of sill plates 24 is located on opposing sides of the glass panel 6 and extends longitudinally along the inside of the sill 10. Referring to FIGS. 14 and 16, one of the sill plates 24 is adjacent to the sill side portion 12 and the other of the sill plates 24 adjacent to sill side portion 14, as previously described for FIGS. 1-11. In FIGS. 12-16, the still plates 24 pivot against the glass gasket 36, impinging force on the gasket and thereby securing the glass panel 6 to the sill 10. In FIGS. 13 and 16, the sill plate impinges a force against the glass gasket 36 by adjustment screws 34 and by the wedge members 44 impinging on the exterior surfaces of the sill plates 24. As best shown in FIG. 14, the interior surface 26 of the sill plate 24 directly impinge against the glass gasket 36 while the wedge member 44 directly impinges on the exterior surface 28 of the sill plate 24. In FIG. 16, the adjustment screws 34 are horizontally positioned against each of the sill plates 24. The adjustment screw 34 can alternatively be positioned so it engages the vertical plane of the sill plate with an acute angle, as discussed for FIG. 9. As illustrated in FIGS. 14-16, the sill plate 24 pivots on the cylindrical member 30 extending longitudinally along the bottom of the sill plate 24 and a groove 32 extending longitudinally in the sill 10. The groove 32 is cylindrically shaped and also sized to receive and hold the cylindrical member 30.

Now turning to the wedge member in greater detail, FIG. 17 shows, in top perspective view, a wedge member 44 typical of embodiments of FIGS. 12-16 and FIGS. 20-23. FIG. 18 shows, in side view, the wedge member 44 of FIG. 17. FIG. 19 shows, in front view, the wedge member 44 of FIG. 17. Referring to FIGS. 17-19, the wedge member 44 includes a top wedge portion 52 and a bottom wedge portion 54 projecting downward from the top wedge portion 52. Together, the top wedge portion 52 and the bottom wedge portion 54 approximate a t-shape. Referring to FIGS. 17-18, the bottom wedge portion 54 includes an upper section 56 with opposing parallel sides and a lower section 58 projecting directly downward from the upper section 56 and with the outside edge of the lower section 58 continuing linearly downward and the inside edge of the lower section 58 drafting inward toward the outside edge. Referring to FIG. 15, this configuration allows the outside edge of the lower section 58 to planarly engage the sill member and the inside edge of the upper section 56 to planarly engage the exterior surface 28 of the sill plate 24. Referring to FIGS. 15, 17, and 18, the inside edge of the lower section 58 of the bottom wedge portion 54 drafts inward so the wedge member 44 can be more easily inserted and removed.

The wedge member 44 can come in a number of discrete thicknesses to provide fine variation of adjustment. For example, an installer could be provided with five of the wedge members 44, starting at ⅛ inch wide (0.00318 meter) to ¼ inch wide (0.00635 meters) in 1/32-inch (0.000795 meter) increments allowing for a total adjustment range of ⅛ inch (0.00318 meter). In another example, the installer could be provided with five of the wedge members 44 starting at ¼ inch (0.00635 meter) and ending in ⅜ inch (0.00953 meter) in 1/32-inch (0.000795 meter) increments. In another example, the installer could be provided with eight of the wedge members 44 starting at 1/16 inch (0.00159 inch) and ending with ¼ inch (0.00635 meter) in 1/64-inch (0.000397 meter) increments. The wedge members 44 can be color coded or otherwise marked with indicia to indicate size. For example, with five of the wedge members 44, ranging from ⅛ inch wide (0.00318 meter) to ¼ inch wide (0.00635 meters) in 1/32-inch (0.000795 meter) increments, ⅛ inch (0.00318 meter) wedge member 44 could be red, a 5/32 inch (0.00397 meter) wedge member 44 could be orange, a 3/16 inch (0.00476 meter) wedge member 44 could be yellow, a 7/32 inch (0.00556 inch) wedge member 44 could be green, and a ¼ inch wedge member 44 (0.00635 meter) could be blue. Total number of wedge members 44, increments, total adjustment range, color, or indicia can be determined based on desirable adjustment ranges and other factors including the convenience for the installer.

While the wedge member 44 in FIGS. 17-19 shows a particular length in proportion to the width and height, the wedge member 44 is not limited to the length shown. The length of the wedge member 44 can vary from the illustration depending on a number of factors that may be particular to the railing design and glass panel used in a particular railing design. For example, longer lengths of the wedge members 44 can be used where equal pressure is an important factor such as with thinner glass. Shorter lengths of the wedge members 44 can be used where the glass may be more likely to exhibit surface thickness tolerances so that more wedges can be installed to compensate for this. Wedge member 44 can, for example, be manufactured by extrusion to readily manufacturer wedge members 44 of different lengths.

The combination of wedge member 44 and adjustment screws 34 provide for greater strength than adjustment screws 34 alone because the adjustment screws 34 provide a small surface area of contact as compared with the wedge member 44. For example, in embodiments such as those in FIGS. 3-4, that use an adjustment screw 34, the force on the adjustment screw from the heavy weight of the glass panel can make the screw difficult to adjust. The combination of wedge member 44 and adjustment screw 34, as illustrated in FIGS. 13, 16, 21, and 23, provide for a greater range of adjustment than the wedge member 44 alone because the adjustment screw can provide for a finer continuous degree of adjustment than the discrete steps of adjustment afforded by wedge members 44.

Figure 22:
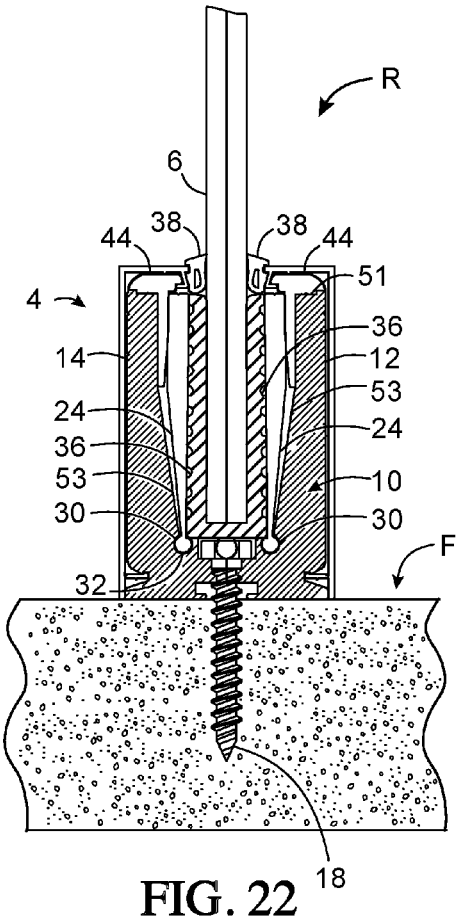
FIG. 22 shows a sectional view of the glass railing assembly of FIG. 20 taken along section lines 22-22.
Figure 23:
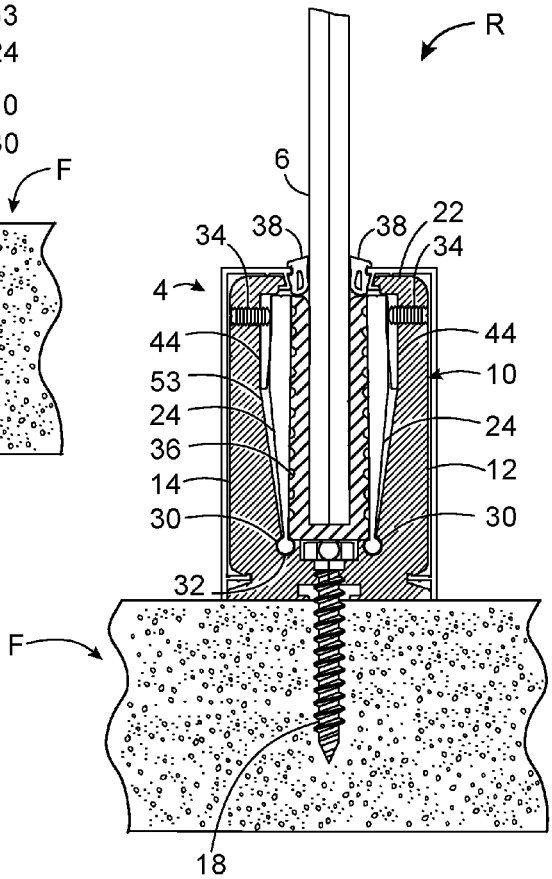
FIG. 23 shows a sectional view of the glass railing assembly of FIG. 20 taken along section lines 23-23.

FIG. 20 shows in top front perspective view, a portion of the second variation of the glass railing assembly R in fully assembly form with an optional cover 8. FIG. 21 shows, in top front perspective view, the glass railing assembly R of FIG. 20 with the optional cover 8 exploded away to reveal the adjustment screw 34 and the wedge member 44. FIG. 22 shows a sectional view of the base member 4 and a portion of the glass panel 6 of the glass railing assembly R of FIG. 20 taken along section lines 22-22. FIG. 23 shows a sectional view of the base member 4 and a portion of the glass panel 6 of the glass railing assembly R of FIG. 20 taken along section lines 23-23. FIGS. 22-23 show the sill 10 secured to the floor F by a threaded fastener 18 able to withstand the day-to-day forces and rotational torque experienced by the glass handrail assembly R. Here the floor F is illustrated as concrete and the threaded fastener 18 is a concrete anchor. However, the floor F can be of any suitable construction able to withstand the rotational forces applied against the handrail, and the threaded fastener 18, any threaded fastener 18 readily known to one skilled in the art for appropriately securing the sill 10 to floor F as previously discussed for FIGS. 15-16.

Referring to FIGS. 20-21, the glass railing assembly R is illustrated with a top handrail 2 mounted along the top longitudinal edge of the glass panel 6. The handrail is shown isolated from glass panel 6 by a gasket 3. Note that the handrail 2 is optional. In an alternative embodiment, the top of the rail can be the glass panel 6 itself where the top of the glass panel 6 is finished and radiused. In FIG. 21, the wedge member 44 is shown positioned flush against the top surface 22 of sill 10. A wedge member 44 is also illustrated exploded away from the top surface 22 of the sill revealing an inset 51 in the top surface 22 of the sill 10. The inset 51 in the sill sized to receive the wedge member 44 and position the top surface of the upper section 56 of the wedge member 44 flush with the top surface 22 of the sill 10. In FIG. 22, the section of FIG. 20 is taken through the wedge member 44 revealing the wedge member seated against the inset 51. In FIG. 23, the section is taken through the adjustment screw 34, the top of the wedge member 44 hidden inside the inset 51 of FIG. 22.

Referring to FIGS. 20-23, the bottom longitudinally edge of the glass panel 6 is secured within the u-shaped interior channel 53 of the sill 10. The bottom longitudinal edge of the glass panel 6 is seated against a glass gasket 36 that is illustrated having substantially u-shape. The glass gasket 36 is illustrated as a "marine glaze gasket" as previously discussed for FIGS. 12-16. A pair of optional second gaskets 38 is positioned on corresponding sides of the glass panel 6 between the glass panel 6 and the top longitudinal inside edge of the sill 10 and provides a watertight seal between the glass panel 6 and the sill 10. Alternatively, a glazing sealant, such as a silicone sealant or alternatively, a structural glazing sealant, can be substituted for the optional second gaskets 38.

A pair of sill plates 24 is located on opposing sides of the glass panel 6 and extends longitudinally along the inside of the sill 10. Referring back to FIGS. 22-23, one of the sill plates 24 is adjacent to the sill side portion 12 and the other of the sill plates 24 adjacent to sill side portion 14, as previously described for FIGS. 1-11. The still plates 24 pivot against the glass gasket 36, impinging force on the gasket and thereby securing the glass panel 6 to the sill 10. In FIGS. 21 and 23, the sill plate impinges a force against the glass gasket 36 by adjustment screws 34 and by the wedge members 44. In FIG. 23, the adjustment screws 34 are horizontally positioned against each of the sill plates 24. The adjustment screw 34 can alternatively be positioned so it engages the vertical plane of the sill plate with an acute angle, as discussed for FIG. 9. As illustrated in FIGS. 22 and 23, the sill plate 24 pivots on the cylindrical member 30 extending longitudinally along the bottom of the sill plate 24 and a groove 32 extending longitudinally in the u-shaped interior channel 53 of the sill 10. The groove 32 is cylindrically shaped and also sized to receive and hold the cylindrical member 30.

Figure 24:
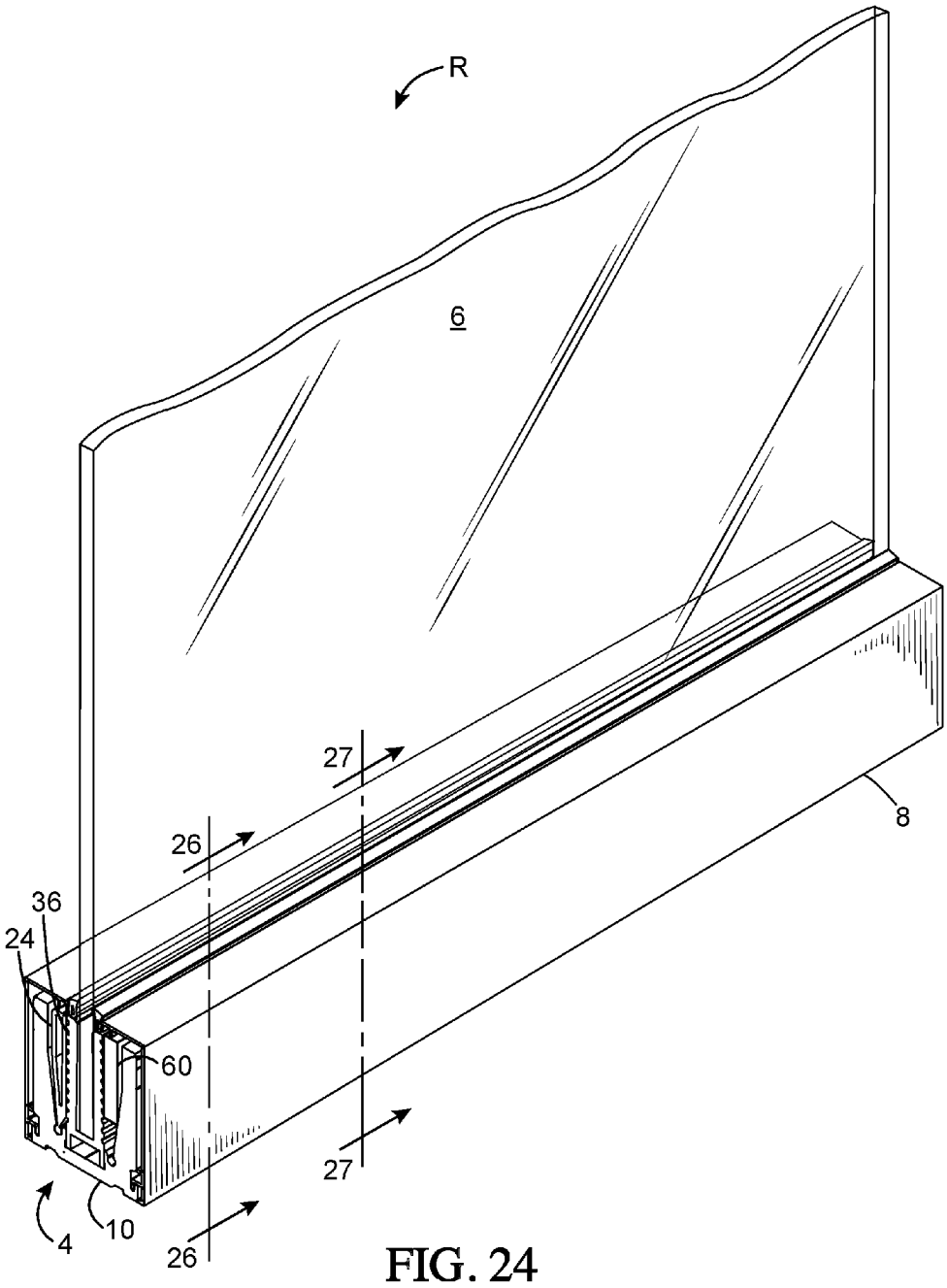
FIG. 24 shows, in top front perspective view, an alternative embodiment a portion of a glass railing assembly utilizing, one sill plate, one or more wedge members, and a block member.

FIG. 24 shows, in top front perspective view, an alternative embodiment a portion of a glass railing assembly R utilizing one of the sill plates 24 instead of two. The embodiment shows a portion of the glass panel 6 and the base member 4. The other sill plate is replaced by a block member 60 that is illustrated with a substantially rectangular cross section and a substantially rectangular body that extends longitudinally along the sill member 10. As in the previously described embodiments, a glass gasket 36 surrounds the bottom edge of the glass panel 6 protecting the glass from breakage. The glass gasket 6 is impinged on one side by the sill plate 24 and on the other by the block member 60. disposed between one or more of the wedge members 44, a block member.

Figure 25:
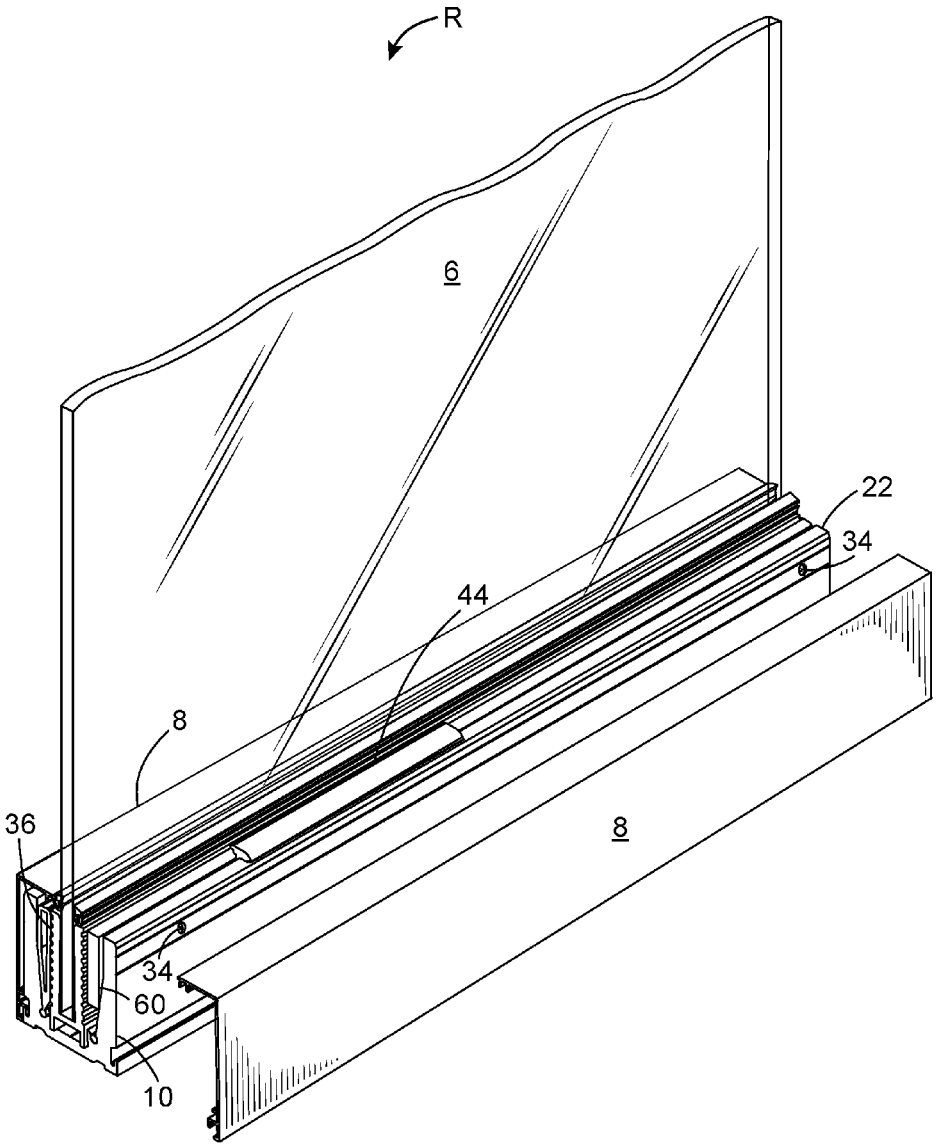
FIG. 25 shows, in top front perspective view, the portion of the glass railing assembly of FIG. 24 with the optional cover removed to reveal the wedge member and the block member.

FIG. 25 shows, in top front perspective view, the portion of the glass railing assembly R of FIG. 24 with the optional cover 8 removed on one side to reveal the wedge member 44 and the adjustment screws 34 in relation to the sill member 10 and the block member 60. A portion of the wedge member 44 is seated against the top surface 22 of the sill member 10 and another portion of the wedge member 44 is disposed between the block member 60 and the glass gasket 36. The wedge member 44 impinges against both the sill member 10 and the block member 60 causing the block member 60 to pivotally impinge against the glass gasket 36 thereby adjusting the angle of the glass panel 6.

Figure 26:
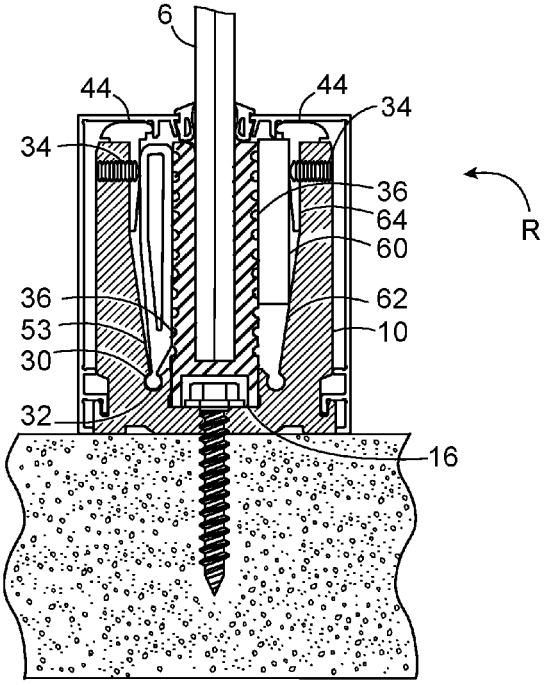
FIG. 26 shows a sectional view of FIG. 24 taken along section lines 26-26 taken through the adjustment screws.
Figure 27:
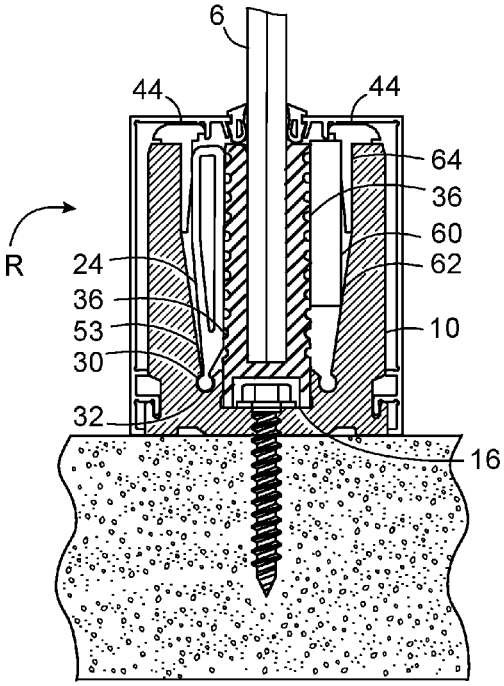
FIG. 27 shows a sectional view of FIG. 24 taken along section lines 27-27 taken through the wedge members.

FIGS. 26 and 27 are show sectional views of portions of the glass railing assembly R of FIG. 24 showing the relationship between the wedge 60, glass gasket 36, sill member 10 and sill plate 24. FIG. 26 shows a sectional view of FIG. 24 taken along section lines 26-26 taken through the adjustment screws 34. FIG. 27 shows a sectional view of FIG. 24 taken along section lines 27-27 taken through the wedge members 44. Referring to FIGS. 26 and 27 one corner of the block member 60 rests against an angled-portion 62 of the u-shaped interior channel 53. The angled-portion 62 drafts directly from the vertical upper-portion 64 and forms an obtuse angle with both the bottom 16 and the vertical upper-portion 64. The wedge member 44 impinges on the upper portion of the block member 60, and causes the block member 60 to pivot on the angled-portion 62, thereby causing the glass panel 6 to rotate.

The opposing side of the glass panel 6 from the block member 60 includes the sill plate 24 hingedly connect to the sill member 10 by way of a cylindrical member 30 of the sill plate 10 captive within the groove 32 in the u-shaped interior channel 53 of the sill member 10 as previously described. In FIG. 26 the adjustment screws 34 are shown impinging against the sill plate 24 on the left side of the figure and against the block member 60 on the right side of the figure. The adjustment screws 34 and the wedge members 44 work in combination as previously described for FIGS. 12-23.

While this invention has been described as having a preferred design, it is understood that it is capable of further modifications, uses and adaptations, both in whole and in part, while following the general principle of the invention and including such departures from the present disclosure as is known or customary practice in the art to which this invention pertains, and as may be applied to the central features of this invention.

What is claimed is:

1. A sill for adjustably securing a glass panel to a floor comprising:

a base member including a top surface and a u-shaped interior channel indented from the top surface and shaped to receive the glass panel, the u-shaped interior channel including a first side, a second side, and a bottom;

a sill plate hingedly mounted proximate to the first side and the bottom and along a longitudinal axis thereof and positioned for receiving the glass panel between the sill plate and the second side;

a wedge member including a bottom wedge portion removably securable between the sill plate and the first side;

the bottom wedge portion includes an upper section and a lower section;

the upper section includes a first side planarly engaging the u-shaped interior channel and a second side opposing and parallel to the first side and planarly engaging the sill plate;

the lower section includes a third side planar with the first side and a fourth side drafting directly inward from the second side;

an adjustment screw extending through the base member and transverse to the longitudinal axis thereof; and the adjustment screw and the wedge member impingable against the sill plate to cause the sill plate and glass panel to pivot therewith.

2. The sill of claim 1, wherein:

the wedge member includes a top wedge portion seatable against the top surface and a bottom wedge portion projecting downward from the top wedge portion and removably securable between the sill plate and the glass panel; and the bottom wedge portion impingable against the sill plate to cause the sill plate and glass panel to pivot therewith.

3. The sill of claim 1, further comprising:

the wedge member is a first wedge member; and a second wedge member removably securable the second side and the glass plate.

4. The sill of claim 3, further comprising:

the second side includes an upper vertical portion and an angled portion extending obliquely between the upper vertical portion and the bottom;

a block member removably extending longitudinally along the angled portion and positioned between the second wedge member and the glass panel; and the second wedge member impingable against the block member causing the block member and glass panel to pivot therewith.

5. The sill of claim 1, further comprising:

a cylindrical recess indented in the first side proximate to the bottom and along a longitudinal axis thereof; and the sill plate includes a cylindrical hinge member at one end thereof pivotally received within the cylindrical recess.

6. The sill of claim 1, further comprising:

a gasket member, including a u-shape; and the gasket member surrounding a bottom longitudinal edge of the glass panel and positioned within the u-shaped interior channel between the sill plate and the second side.

7. A sill for adjustably securing a glass panel to a floor comprising:

a base member including a top surface and a u-shaped interior channel indented from the top surface, the u-shaped interior channel including opposing sides and a bottom;

first and second sill plates hingedly mounted on corresponding first and second sides of the opposing sides proximate to the bottom of the u-shaped interior and along a longitudinal axis thereof for receiving the glass panel therebetween;

first and second wedge member each include a bottom wedge portion removably securable between corresponding sill plates of the first and second sill plates and the u-shaped interior channel;

each bottom wedge portion includes an upper section and a lower section;

the upper section includes a first side planarly engaging the u-shaped interior channel and a second side opposing and parallel to the first side and planarly engaging the corresponding sill plate of the first and second sill plate; and the lower section includes a third side planar with the first side and a fourth side drafting directly inward from the second side;

first and second adjustment screws each extending through the base member and transverse to the longitudinal axis thereof; and the first and second adjustment screws and the first and second wedge members impingable against the corresponding sill plates of the first and second sill plate to cause the first and second sill plates and glass panel to pivot therewith.

8. The sill as in claim 7, wherein the first and second sill plates are shaped and aligned as mirror images within the u-shaped interior channel whereby identically sized and shaped first and second wedge members create equal pressure on corresponding first and second sill plates.

9. The sill of claim 7, further comprising:

first and second cylindrical recesses indented in the opposing sides of the u-shaped interior channel proximate to the bottom and along a longitudinal axis thereof; and each of the first and second sill plates includes a corresponding cylindrical hinge member at one end thereof pivotally received within a corresponding cylindrical recess of the first and second cylindrical recesses.

10. The sill of claim 7, further comprising:

a gasket member, including a u-shape; and the gasket member positioned within u-shaped interior channel between the first and second sill plates and the glass panel.

11. A sill for adjustably securing a glass panel to a floor comprising:

a base member including a top surface and a u-shaped interior channel indented from the top surface, the u-shaped interior channel including opposing sides and a bottom;

first and second sill plates hingedly mounted on corresponding first and second sides of the opposing sides proximate to the bottom of the u-shaped interior and along a longitudinal axis thereof for receiving the glass panel therebetween;

first and second wedge members each including a top wedge portion and a bottom wedge portion projecting downward from the top wedge portion and removably securable between corresponding sill plates of the first and second sill plates and the u-shaped interior channel;

each bottom wedge portion of the first and second wedge members includes an upper section and a lower section;

the upper section includes a first side planarly engaging the u-shaped interior channel and a second side opposing and parallel to the first side and planarly engaging the corresponding sill plate of the first and second sill plate; and the lower section includes a third side planar with the first side and a fourth side drafting directly inward from the second side;

first and second insets, indented from the top surface, sized and shaped to receive and seat the top wedge portion flush with the top surface of the base member;

adjustment screws extending through the base member and transverse to the longitudinal axis thereof for adjustable contact against each of the pair of sill plates; and the adjustment screws and the wedge bottom portion impingable against the corresponding sill plate of the first and second sill plates to cause the first and second sill plates and glass panel to pivot therewith.

12. The sill of claim 11, wherein the first and second sill plates are shaped and aligned as mirror images within the u-shaped interior channel whereby identically sized and shaped first and second wedge members create equal pressure on corresponding first and second sill plates.

13. The sill of claim 11, further comprising:

first and second cylindrical recesses indented in the opposing sides proximate to the bottom and along a longitudinal axis thereof; and each of the first and second sill plates includes a corresponding cylindrical hinge member at one end thereof pivotally received within a corresponding cylindrical recess of the first and second cylindrical recesses.

14. The sill of claim 11, further comprising:

a gasket member, including a u-shape; and the gasket member positioned within u-shaped interior channel between the first and second sill plates and the glass panel.

15. A sill for adjustably securing a glass panel to a floor comprising:

a base member including a first top surface and a u-shaped interior channel indented from the top surface and shaped to receive the glass panel, the u-shaped interior channel including a first side, a second side, and a bottom;

a sill plate hingedly mounted proximate to the first side and the bottom and along a longitudinal axis thereof and positioned for receiving the glass panel between the sill plate and the second side;

a wedge member including a top wedge portion and a bottom wedge portion;

the top wedge portion seated simultaneously against the first top surface of the base member and a second top surface of the sill plate;

the bottom wedge portion projects downward from the top wedge portion removably secured between the sill plate and the first side;

an adjustment screw extending through the base member and transverse to the longitudinal axis thereof; and the adjustment screw and the bottom wedge portion impinges against the sill plate to cause the sill plate and glass panel to pivot therewith.

* * * * *